US010543956B2

(12) United States Patent
May et al.

(10) Patent No.: US 10,543,956 B2
(45) Date of Patent: Jan. 28, 2020

(54) DISPENSER AND PROCESS

(71) Applicant: James Alexander Corporation, Blairstown, NJ (US)

(72) Inventors: Richard James May, Saylorsburg, PA (US); Jeffrey Rendano, Kunkletown, PA (US)

(73) Assignee: James Alexander Corporation, Blairstown, NJ (US)

( * ) Notice: Subject to any disclaimer, the term of this patent is extended or adjusted under 35 U.S.C. 154(b) by 0 days.

(21) Appl. No.: 15/682,016

(22) Filed: Aug. 21, 2017

(65) Prior Publication Data

US 2018/0050859 A1 Feb. 22, 2018

Related U.S. Application Data

(60) Provisional application No. 62/377,821, filed on Aug. 22, 2016.

(51) Int. Cl.
*B65D 17/50* (2006.01)
*B05C 17/005* (2006.01)
(Continued)

(52) U.S. Cl.
CPC ..... *B65D 17/50* (2013.01); *B05C 1/04* (2013.01); *B05C 1/06* (2013.01);
(Continued)

(58) Field of Classification Search
CPC ... A61M 35/003; A61M 35/006; B65D 25/08; B65D 35/22; B65D 35/28; B65D 47/2037; B65D 81/3244; B65D 81/3266
(Continued)

(56) References Cited

U.S. PATENT DOCUMENTS 3,567,061 A 3/1971 Song
3,684,136 A 8/1972 Baumann
(Continued)

FOREIGN PATENT DOCUMENTS

WO 0246089 A2 6/2002
WO 2002046089 A3 8/2002
(Continued)

*Primary Examiner* — David P Angwin
*Assistant Examiner* — Bradley S Oliver
(74) *Attorney, Agent, or Firm* — Schacht Law Office, Inc.; Paul J. Nykaza

(57) ABSTRACT

A dispenser (10) for dispensing flowable materials has a container (12) having an outer wall (20), a dividing wall (21) and a membrane (14) operably connected to define a first chamber (22), a second chamber (24) and a third chamber (16). The dividing wall (21) is connected to the membrane (14) at an interface (30). The first chamber (22) defines a first volume and is configured to contain a first flowable material (M1), and the second chamber (24) defines a second volume and is configured to contain a second flowable material (M2). The membrane (14) has a first section (34) having a first rupturable member (40) and a second section (36) having a second rupturable member (40). The first section (34) is separated from the second section (36) by the interface (30). The third chamber (16) is positioned adjacent the membrane (14) generally opposite the first chamber (22) and the second chamber (24), wherein the third chamber (16) defines a third volume and is configured to receive the first flowable material (M1) and the second flowable material (M2) upon rupture of the first rupturable member (40) and the second rupturable member (40) wherein a mixture (MX) is formed. The first volume and the second volume are collectively approximately equal to the third volume.

39 Claims, 18 Drawing Sheets

(51) Int. Cl.

| | |
|---|---|
| ***B65D 83/00*** | (2006.01) |
| ***B65D 81/32*** | (2006.01) |
| ***B65D 35/36*** | (2006.01) |
| ***B65D 47/20*** | (2006.01) |
| ***B05C 1/06*** | (2006.01) |
| ***B05C 1/04*** | (2006.01) |

(52) U.S. Cl.
CPC .. *B05C 17/00553* (2013.01); *B05C 17/00583* (2013.01); *B65D 35/36* (2013.01); *B65D 47/2037* (2013.01); *B65D 81/3266* (2013.01); *B65D 83/00* (2013.01); *B65D 83/0005* (2013.01)

(58) Field of Classification Search
USPC ..... 401/132–135, 158, 165
See application file for complete search history.

(56) References Cited

U.S. PATENT DOCUMENTS

| | | | | |
|---|---|---|---|---|
| 4,457,962 | A | 7/1984 | Jaffe et al. | |
| 4,784,506 | A | 11/1988 | Koreska et al. | |
| 4,997,083 | A * | 3/1991 | Loretti | A61J 1/2093 206/219 |
| 5,169,030 | A | 12/1992 | Lewin | |
| 5,244,120 | A * | 9/1993 | O'Meara | B65D 35/22 222/94 |
| 5,269,441 | A * | 12/1993 | O'Meara | B65D 35/22 215/6 |
| 5,409,736 | A | 4/1995 | Leiner et al. | |
| 5,538,353 | A | 7/1996 | DeHavilland | |
| 5,772,346 | A | 6/1998 | Edwards | |
| 6,315,165 | B1 | 11/2001 | Regan | |
| 6,379,069 | B1 | 4/2002 | May | |
| 6,729,786 | B1 * | 5/2004 | Tufts | A45D 34/04 401/132 |
| 6,779,657 | B2 * | 8/2004 | Mainwaring | B65D 25/08 206/15.3 |
| 6,991,394 | B2 | 1/2006 | Tufts et al. | |
| 7,182,536 | B2 | 2/2007 | Tufts et al. | |
| 7,516,872 | B2 | 4/2009 | Boone et al. | |
| 7,581,899 | B2 * | 9/2009 | May | A45D 34/04 401/132 |
| 7,631,645 | B2 * | 12/2009 | Gayton | A45D 19/02 132/112 |
| 7,824,122 | B2 | 11/2010 | Flores et al. | |
| 7,909,808 | B2 | 3/2011 | Stenton | |
| 7,976,234 | B2 * | 7/2011 | May | B65D 81/3244 222/541.4 |
| D651,339 | S | 12/2011 | Kirk et al. | |
| 8,100,294 | B2 | 1/2012 | May et al. | |
| 8,342,765 | B2 * | 1/2013 | Stenton | A61B 17/00491 222/213 |
| 8,348,913 | B2 * | 1/2013 | Hoang | A45D 34/04 604/310 |
| 8,403,178 | B2 | 3/2013 | May et al. | |
| 8,518,076 | B2 | 8/2013 | Stenton | |
| 8,702,751 | B2 | 4/2014 | Stenton | |
| 8,794,858 | B2 | 8/2014 | Kirk et al. | |
| 8,801,312 | B2 | 8/2014 | Guzman et al. | |
| 8,864,399 | B2 | 10/2014 | Guzman et al. | |
| 8,910,830 | B2 | 12/2014 | May | |
| 9,119,946 | B2 | 9/2015 | Dokken et al. | |
| 9,265,923 | B2 | 2/2016 | Boone et al. | |
| 9,334,098 | B1 * | 5/2016 | Hughes | B65D 81/3266 |
| 9,675,787 | B2 | 6/2017 | Guzman | |
| 9,757,551 | B2 * | 9/2017 | Degala | A61L 2/18 |
| 2002/0012563 | A1 | 1/2002 | May | |
| 2003/0106905 | A1 | 6/2003 | Chan et al. | |
| 2003/0209561 | A1 | 11/2003 | Thomas et al. | |
| 2004/0155059 | A1 | 8/2004 | Harper | |
| 2004/0179888 | A1 * | 9/2004 | Tufts | A45D 34/04 401/133 |
| 2005/0072442 | A1 * | 4/2005 | Licari | A45D 19/02 132/112 |
| 2007/0131713 | A1 | 6/2007 | Hill | |
| 2007/0253761 | A1 | 11/2007 | May | |
| 2007/0269253 | A1 * | 11/2007 | Caro | B01F 5/0682 401/132 |
| 2008/0046004 | A1 * | 2/2008 | Stenton | A61M 35/003 606/214 |
| 2008/0167681 | A1 * | 7/2008 | Stenton | A61B 17/00491 606/214 |
| 2009/0196675 | A1 | 8/2009 | May et al. | |
| 2009/0311030 | A1 | 12/2009 | Stenton | |
| 2014/0227019 | A1 | 8/2014 | May et al. | |
| 2015/0101942 | A1 * | 4/2015 | Wu | B65D 81/3211 206/219 |
| 2017/0354406 | A1 | 12/2017 | Miller et al. | |
| 2018/0022526 | A1 * | 1/2018 | Demarest | B05C 17/00553 433/90 |
| 2018/0050858 | A1 * | 2/2018 | May | B05C 1/04 |

FOREIGN PATENT DOCUMENTS

| | | | |
|---|---|---|---|
| WO | 2009097428 | A1 | 8/2009 |
| WO | 2015042021 | A1 | 3/2015 |

* cited by examiner

FIG. 29
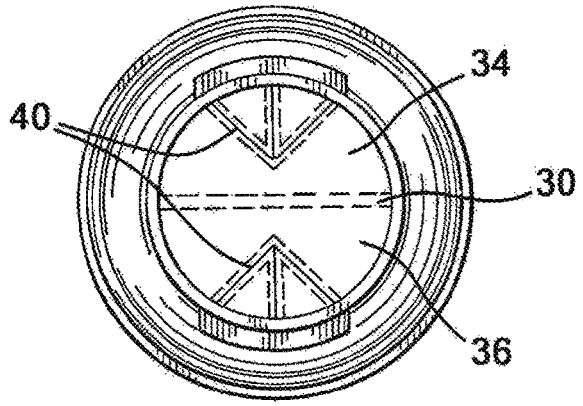
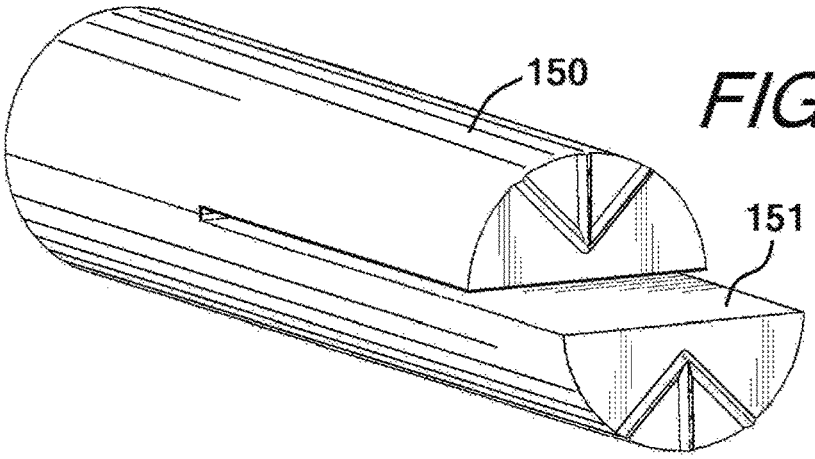
FIG. 30
FIG. 31
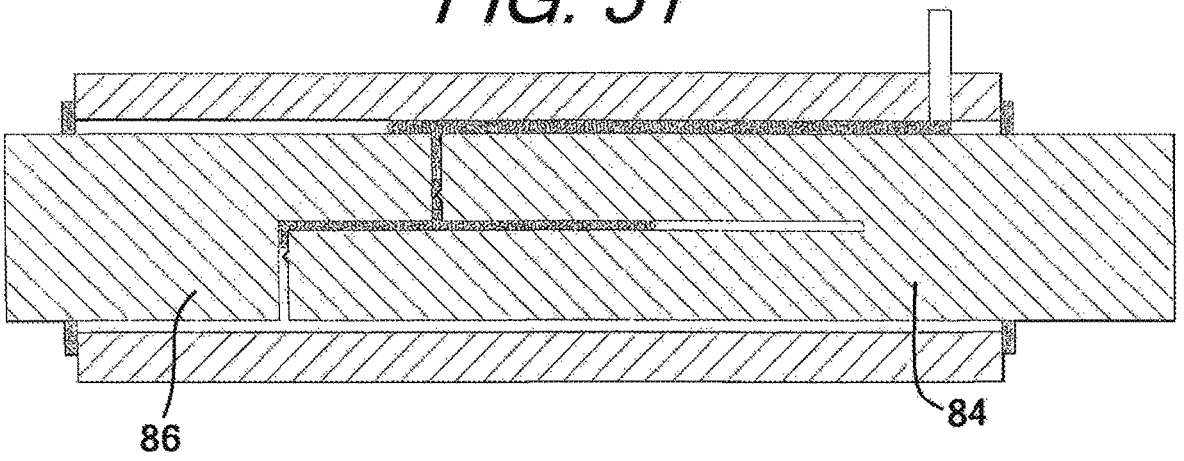

FIG. 38
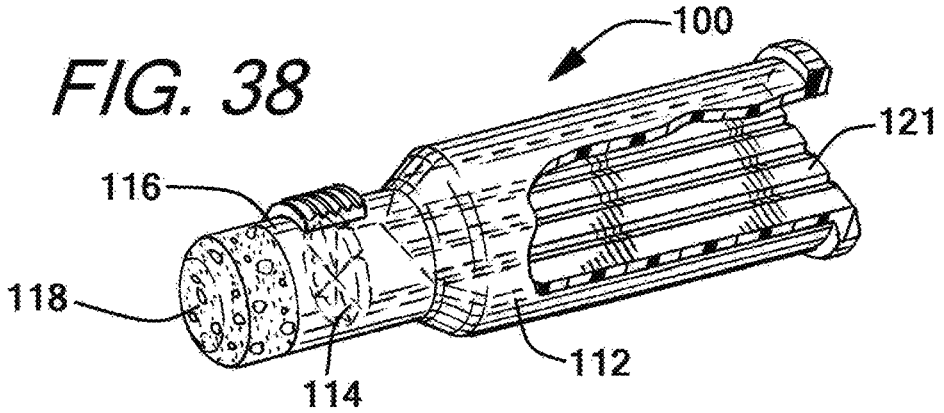
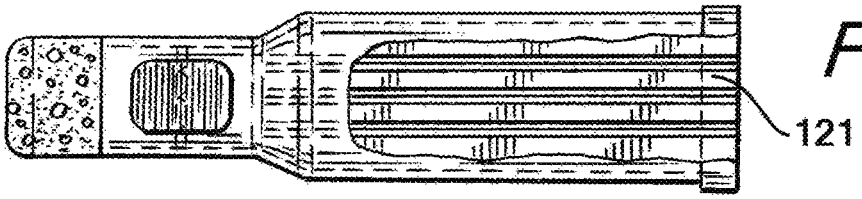
FIG. 39
FIG. 40
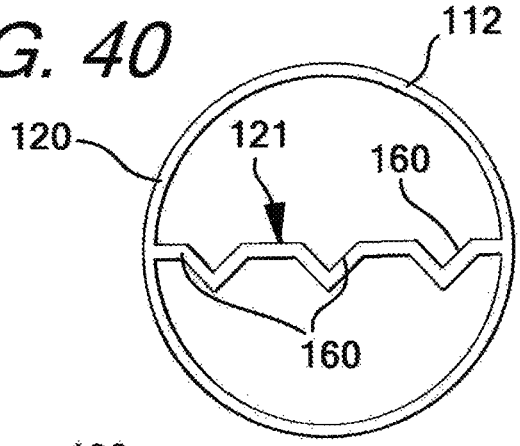
FIG. 41
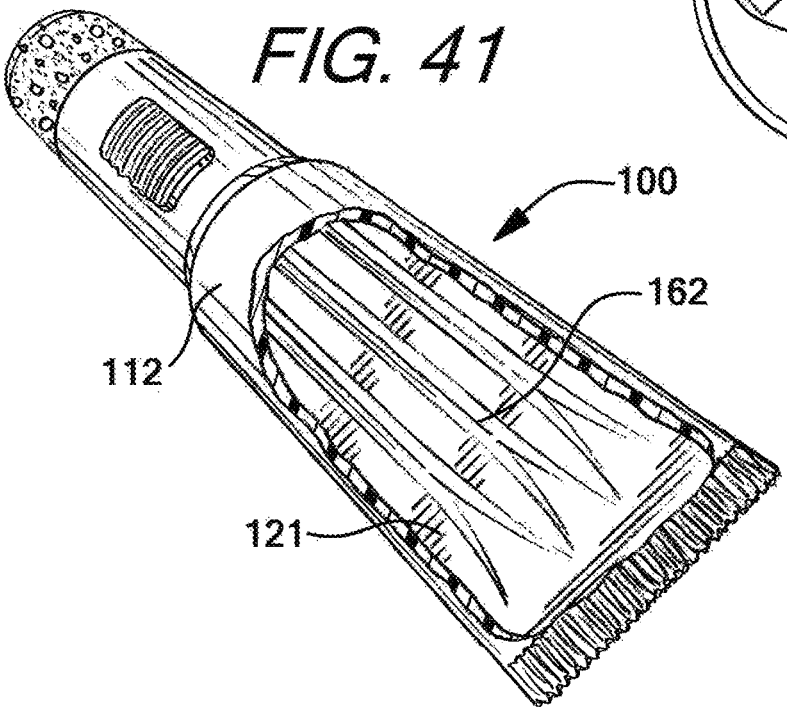

DISPENSER AND PROCESS

CROSS-REFERENCE TO RELATED APPLICATIONS

The present application claims the benefit of U.S. Patent Application No. 62/377,821, filed on Aug. 22, 2016, which application is incorporated by reference herein.

FEDERALLY SPONSORED RESEARCH OR DEVELOPMENT

None.

TECHNICAL FIELD

The invention relates generally to a dispenser for a flowable material or substance and more particularly, to a multi-chambered dispenser wherein multiple flowable substances can be separately stored and when desired, sufficiently mixed together to form a mixture as required for a particular application, and wherein the mixture is dispensed as desired.

BACKGROUND OF THE INVENTION

Containers capable of dispensing contents stored in the containers are known in the art. In certain applications, it is desired to mix separately contained materials. Containers may be constructed such that the materials are stored in separate chambers or compartments and then mixed together at a desired time. The resulting mixture is then dispensed from the container. The separately stored contents can also be dispensed separately as desired. In some prior art designs, the structures of the container result in difficulties in sufficiently mixing the stored contents. Consequently, the dispensed mixture is not sufficiently or properly mixed prior to being dispensed. In addition, with certain prior art designs, it is difficult to more efficiently separately store different amounts of components to be later mixed in a dispenser.

While such containers, according to the prior art, provide a number of advantageous features, they nevertheless have certain limitations. The present invention is provided to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention provides a multi-chambered dispenser for dispensing flowable materials. In one preferred embodiment, multiple flowable substances can be separately stored in the dispenser, mixed at a desired time, and then dispensed from the dispenser. The flowable materials can also be dispensed separately as desired by the user.

According to a first aspect of the invention, a dispenser is provided for dispensing flowable materials. A container has an outer wall, a dividing wall and a membrane operably connected to define a first chamber, a second chamber and a third chamber. The dividing wall is connected to the membrane at an interface. The first chamber defines a first volume and is configured to contain a first flowable material. The second chamber defines a second volume and is configured to contain a second flowable material. The membrane has a first section having a first rupturable member and a second section having a second rupturable member. The first section is separated from the second section by the interface. The third chamber is positioned adjacent the membrane generally opposite the first chamber and the second chamber. The third chamber defines a third volume and is configured to receive the first flowable material and the second flowable material upon rupture of the first rupturable member and the second rupturable member wherein a mixture is formed. The first volume and the second volume is collectively approximately equal to the third volume.

According to another aspect of the invention, the third chamber is a mixing chamber wherein the mixing chamber is dimensioned such that the mixing chamber is capable of receiving the entire amount of the first flowable material from the first chamber and the entire amount of the second flowable material from the second chamber.

According to another aspect of the invention, the membrane of the dispenser has a first section confronting the first chamber, wherein the first section has a weld seam, and a second section confronting the second chamber, wherein the second section has a weld seam. The first section of the membrane is separated from the second section of the membrane by a non-rupturable member that is operably associated with the dividing wall.

According to another aspect of the invention, a membrane is provided for use in a dispenser having a first chamber configured to hold a first flowable material M1 and a second chamber configured to hold a second flowable material M2. The membrane comprises a first section having a first rupturable member, a second section having a second rupturable member, and a non-rupturable member separating the first and second sections of the membrane.

According to another aspect of the invention, a dispenser is provided comprising a container having an outer wall, a dividing wall, and a membrane operably connected to define a first chamber, a second chamber, and a mixing chamber. The first chamber contains a first flowable material M1 and the second chamber contains a second flowable material M2. The membrane has a first section confronting the first chamber and has a plurality of first weld seams, and the second section confronts the second chamber and has a plurality of second weld seams. The dividing wall has an end connected to the membrane to define a non-rupturable member that separates the first section and the second section. The membrane is positioned in the container such that a mixing chamber is defined at a location adjacent the membrane so that when pressure is applied to the membrane, the pressure causes rupture of the first weld seam and the second weld seam wherein the first flowable material M1 flows past the first section of the membrane and into the mixing chamber and the second flowable material M2 flows past the second section of the membrane and into the mixing chamber. The first flowable material M1 mixes with the second flowable material M2 to form a mixture in which the mixture is dispensed from the mixing chamber. The mixing chamber has a volume that is generally equal to or greater than the collective volume of the first chamber and the second chamber.

According to another aspect of the invention, the plurality of weld seams of the first section and the second section converge to a point spaced from the non-rupturable membrane.

According to another aspect of the invention, a length of the mixing chamber is generally equal to a length of the first chamber and the second chamber. The mixing chamber may be in the form of an elongated cylindrical tube.

According to another aspect of the invention, the first section of the membrane is offset from the second section of the membrane According to a further aspect of the invention, the interface defines a generally planar member and is positioned generally transverse to the first section of the membrane and the second section of the membrane.

According to another aspect of the invention, the container has a unsealed distal end configuration wherein the dividing wall has a plurality of undulations. The container has a sealed distal end configuration wherein the undulations have a generally flattened configuration. The undulations may be one of v-shaped notches, u-shaped notches or zigzag shaped structures.

According to another aspect of the invention, a fracturing mechanism is operably connected to the container. The fracturing mechanism has a first extending member and a second extending member. The first extending member and the second extending member is positioned on the container in generally opposed relation. The first extending member has a first projection positioned proximate the first section of the membrane and the second extending member has a second projection positioned proximate the second section of the membrane. In response to deflection of the extending members towards one another, the projections deflect the outer wall proximate the membranes wherein the first weld seam and the second weld seam fracture creating an opening through the first section of the membrane and the second section of the membrane configured to allow the flowable materials to pass through the membrane sections and from the dispenser.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

Figure 1:
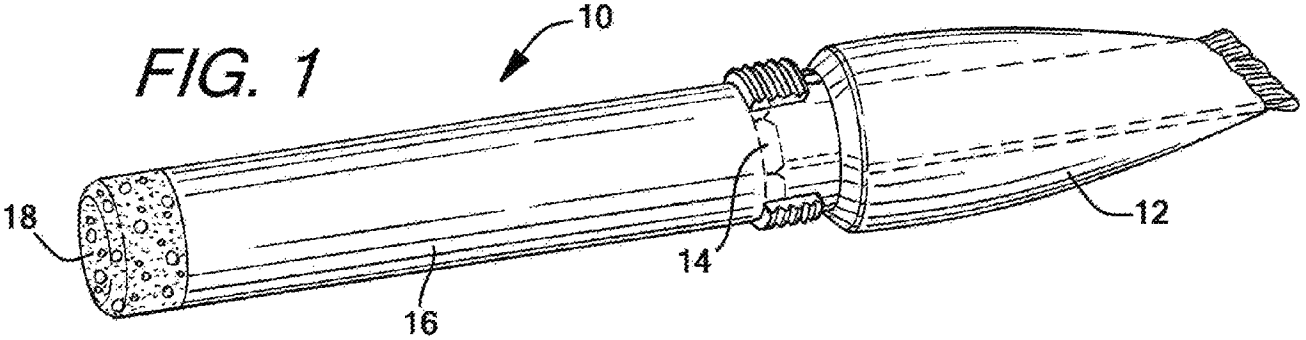
FIG. 1 is a perspective view of a dispenser according to the present invention.
Figures 17, 18, 19, 20:
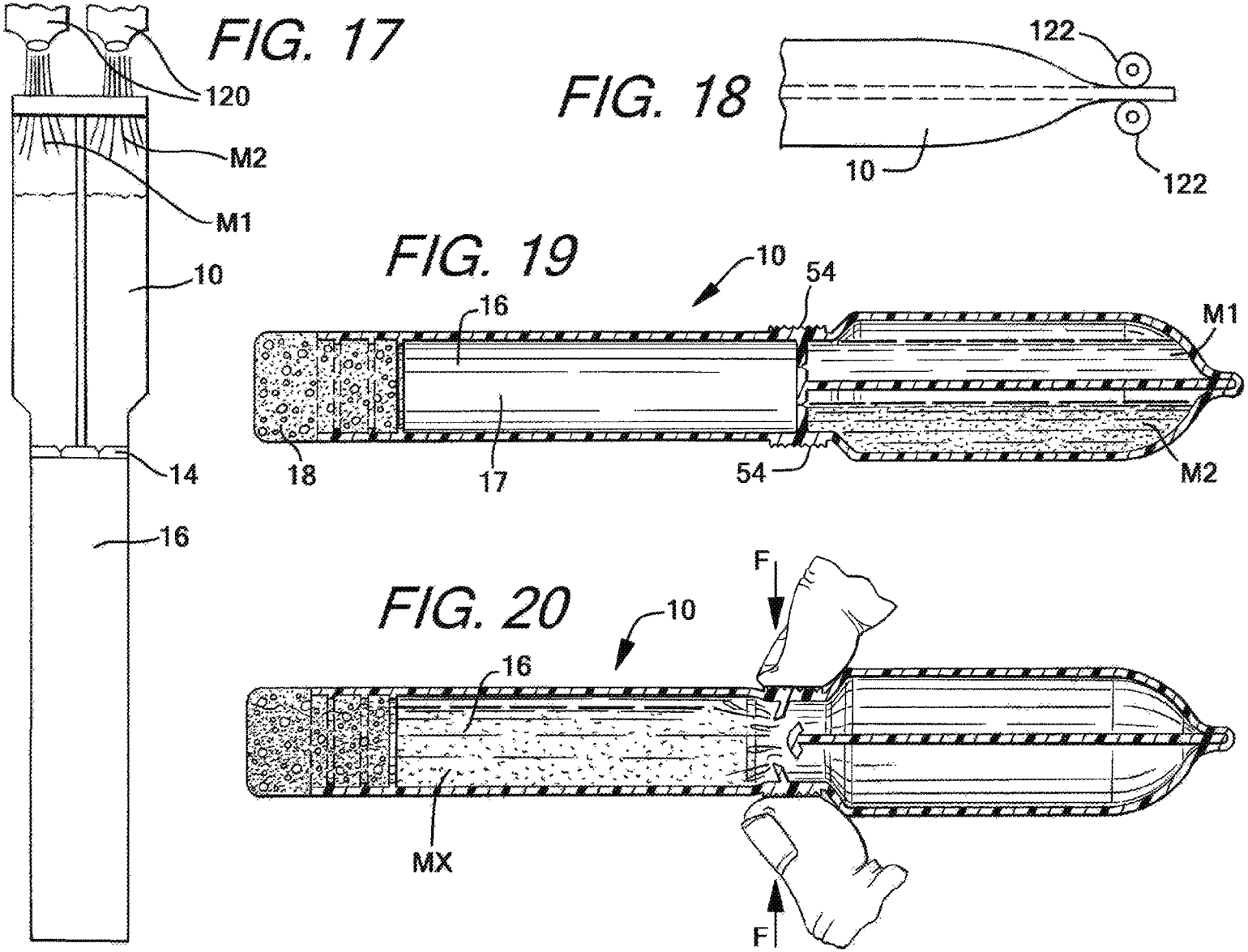
Figure 21:
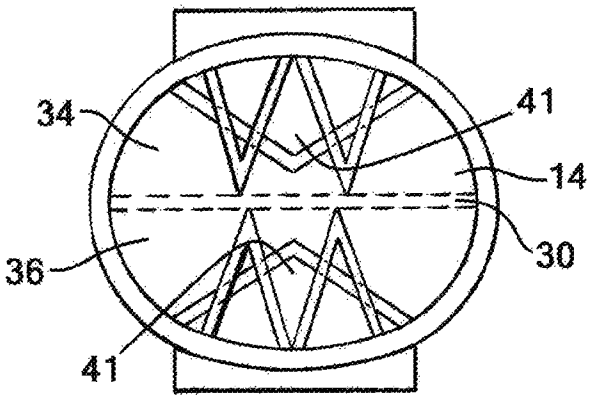
Figure 22:
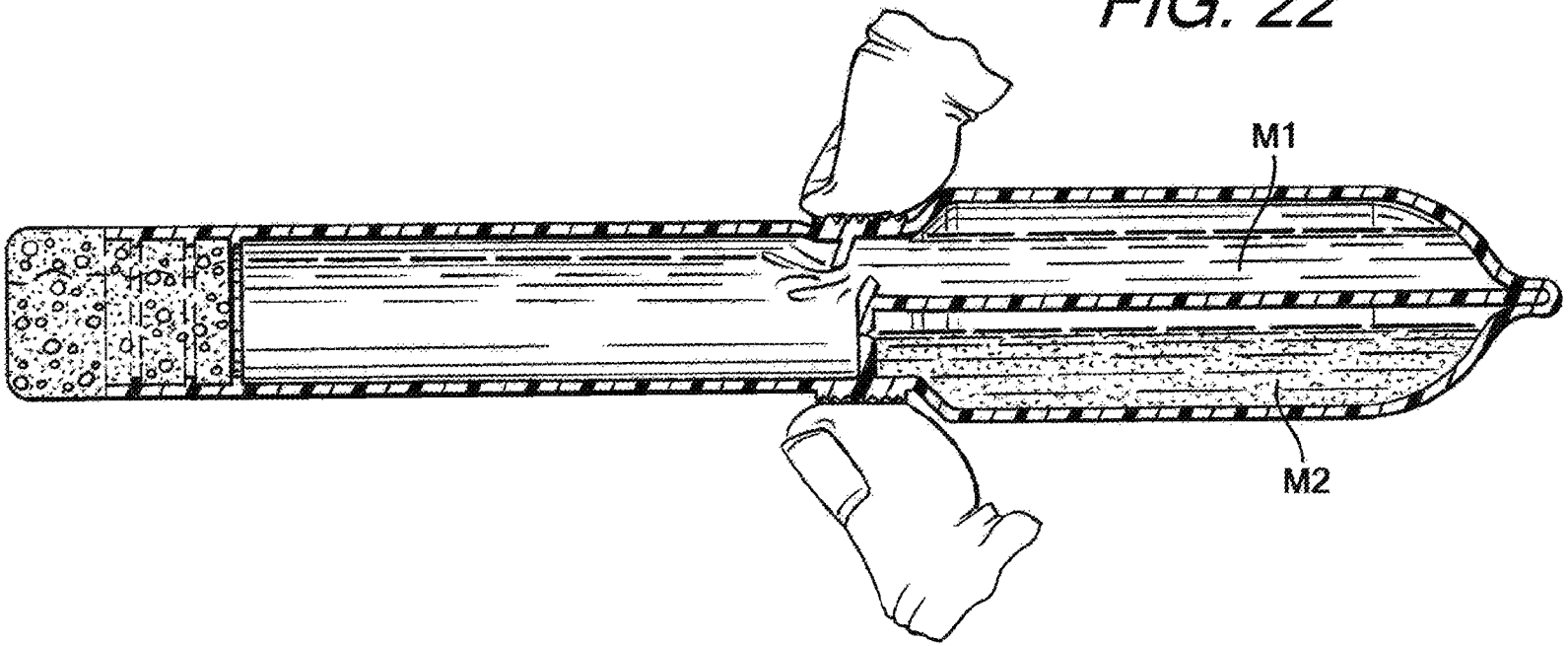
Figure 23:
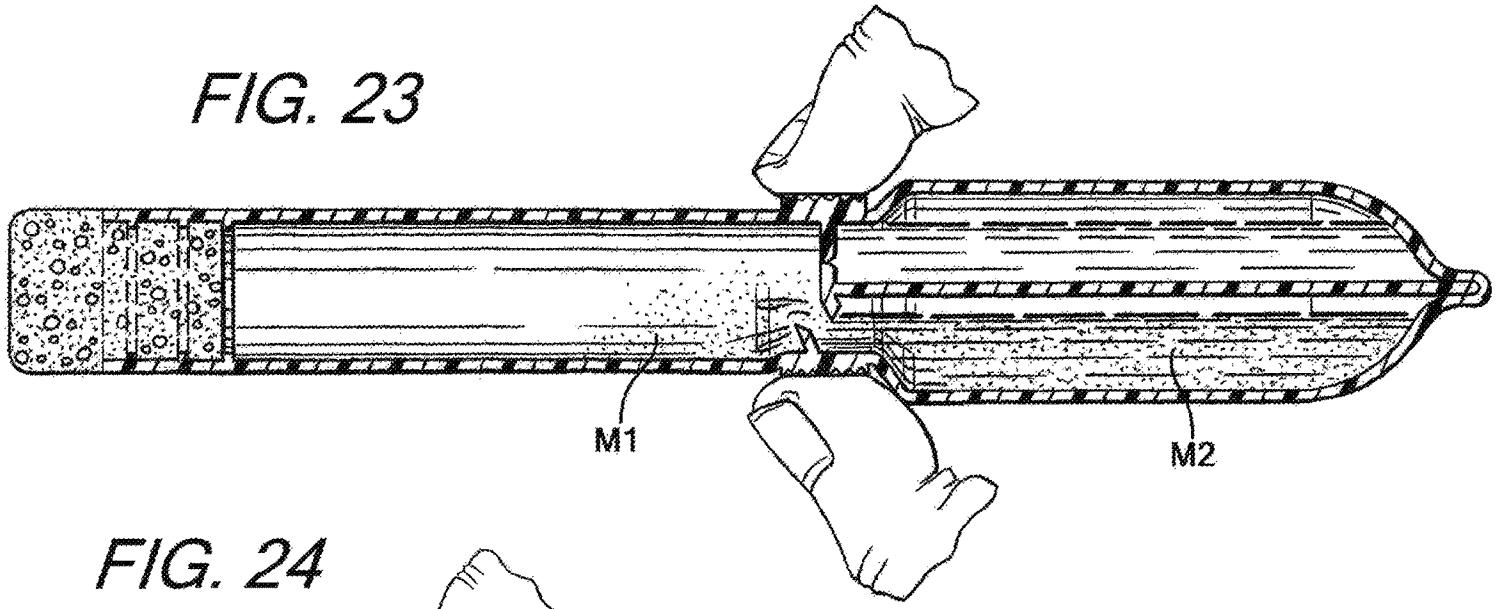
Figure 24:
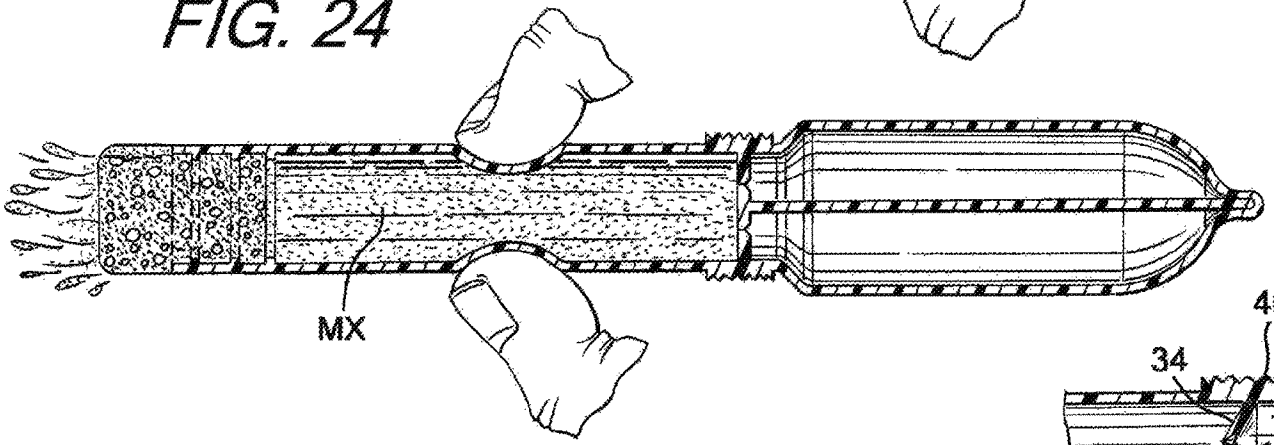
Figure 25:
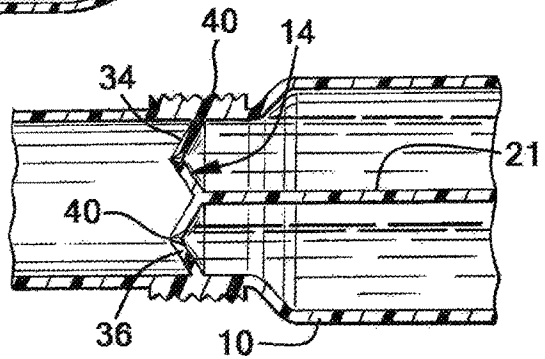
Figure 26:
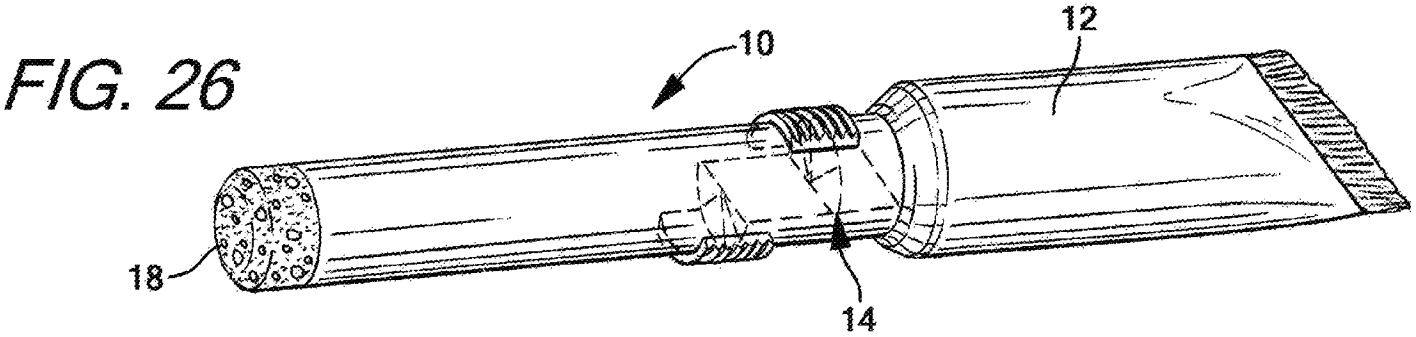
Figure 27:
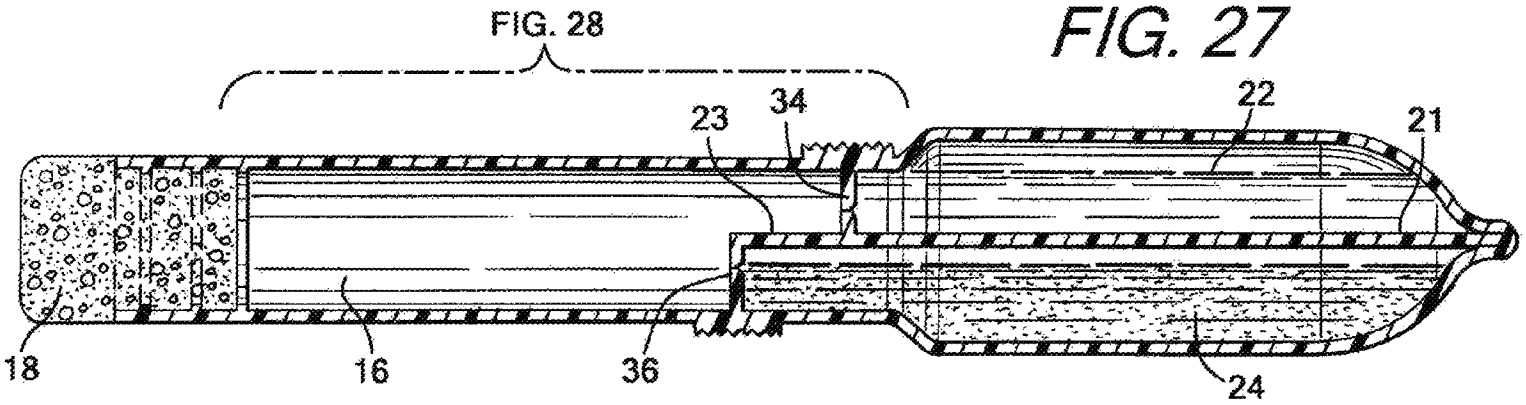
Figure 28:
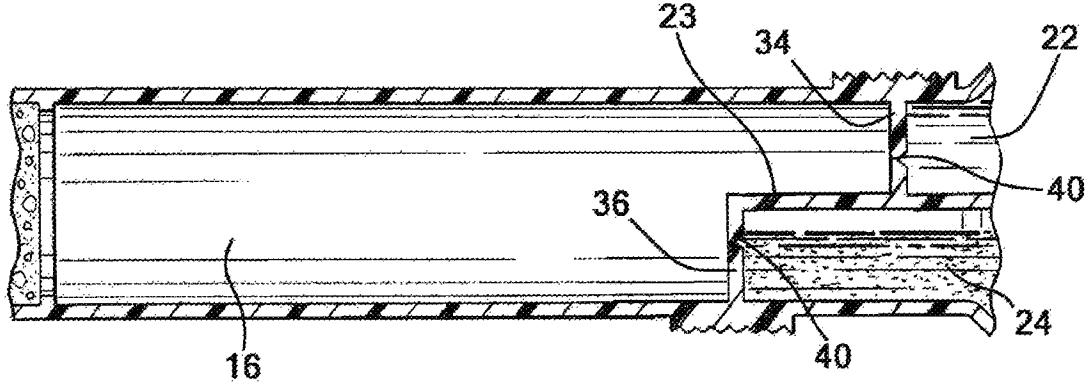
Figure 32:
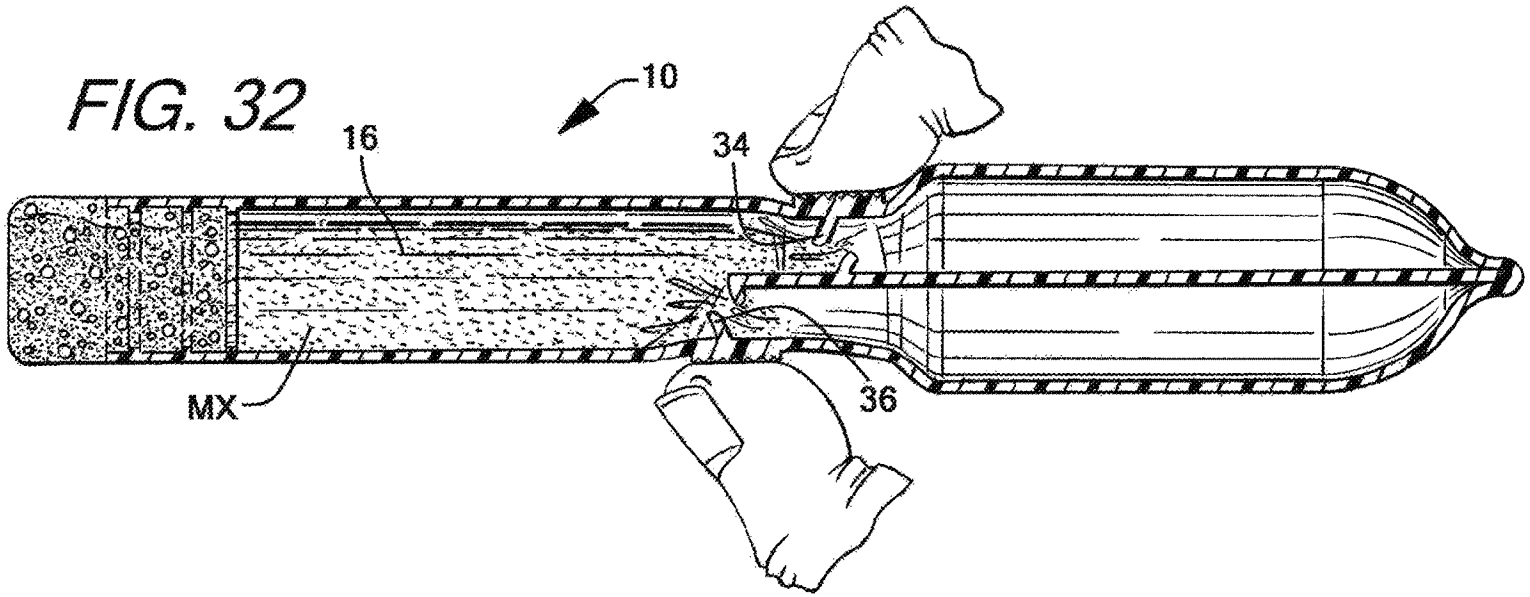
Figure 33:
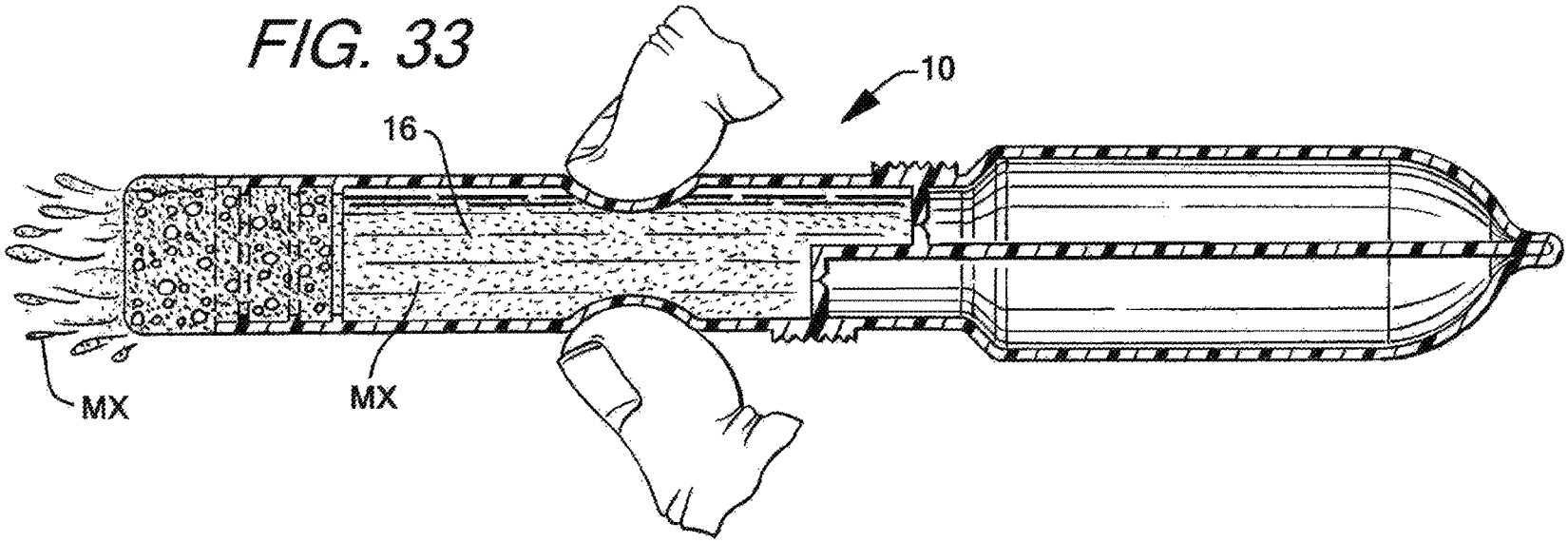
Figure 34:
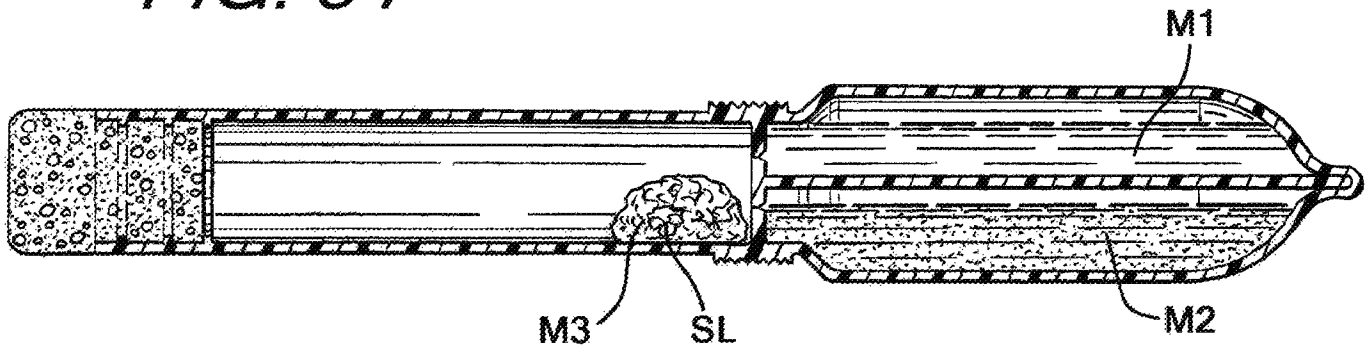
Figure 35:
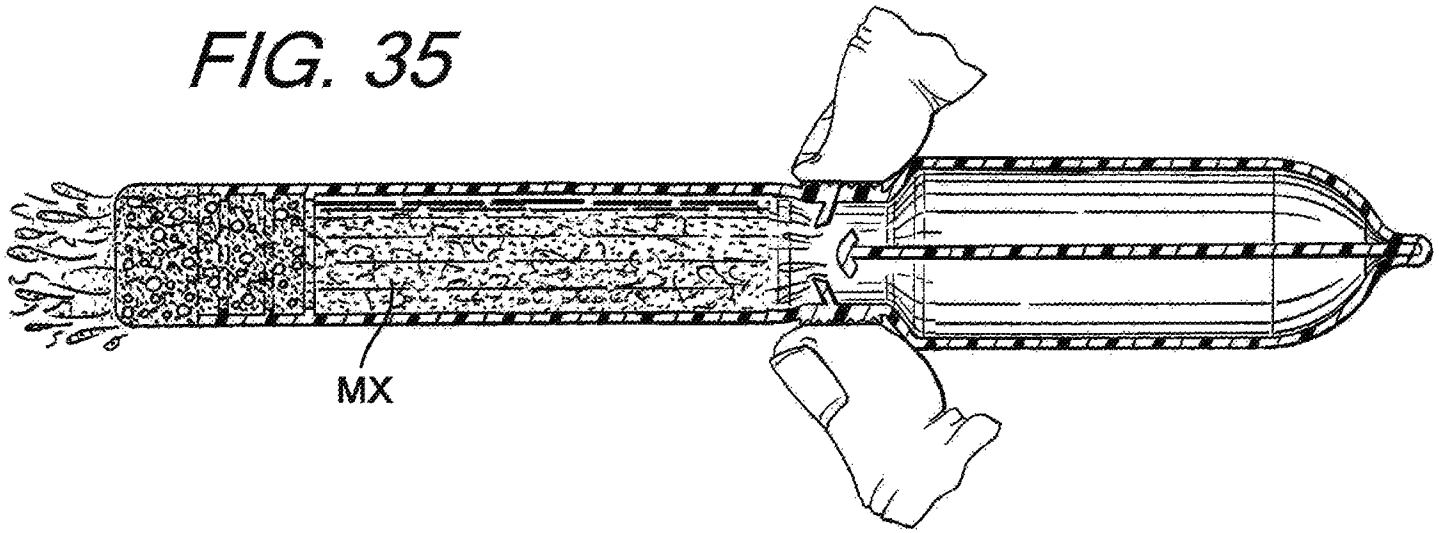
Figure 36:
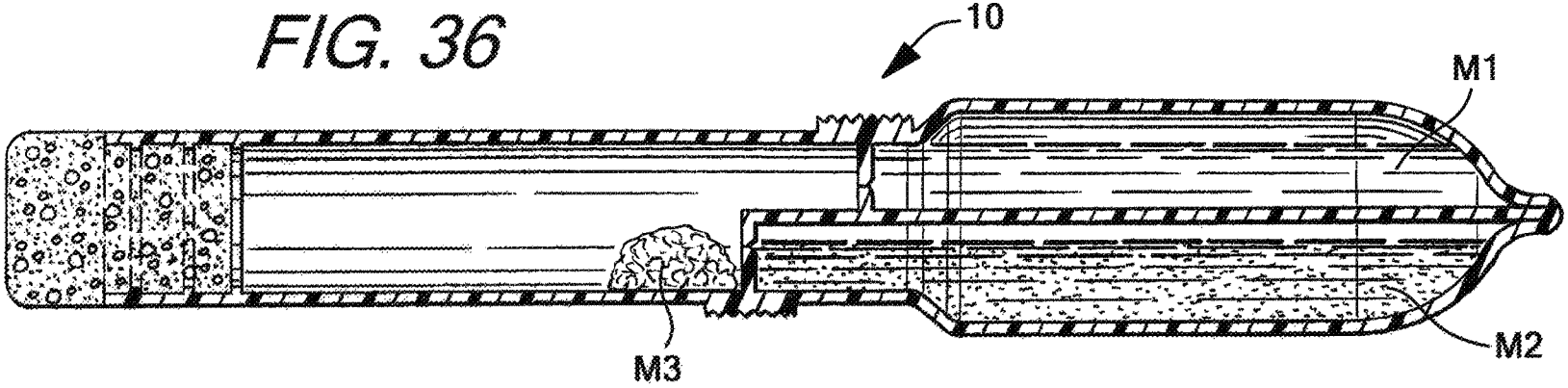
Figure 37:
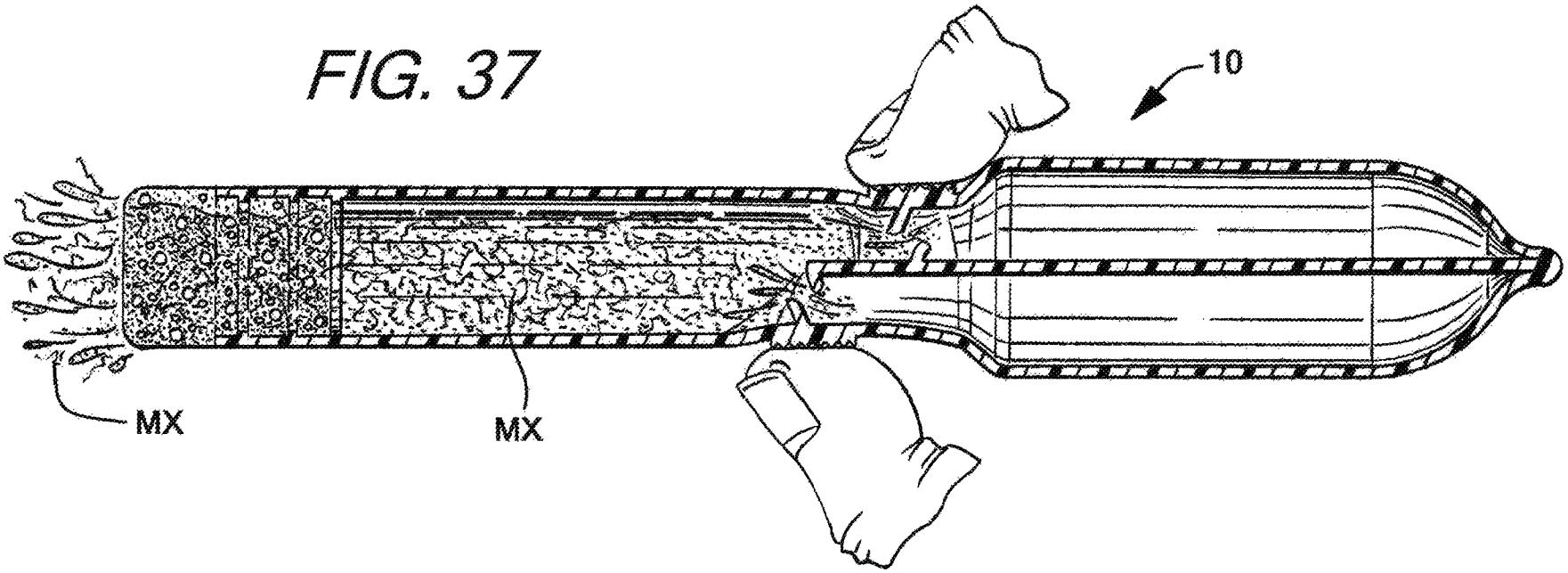
Figure 42:
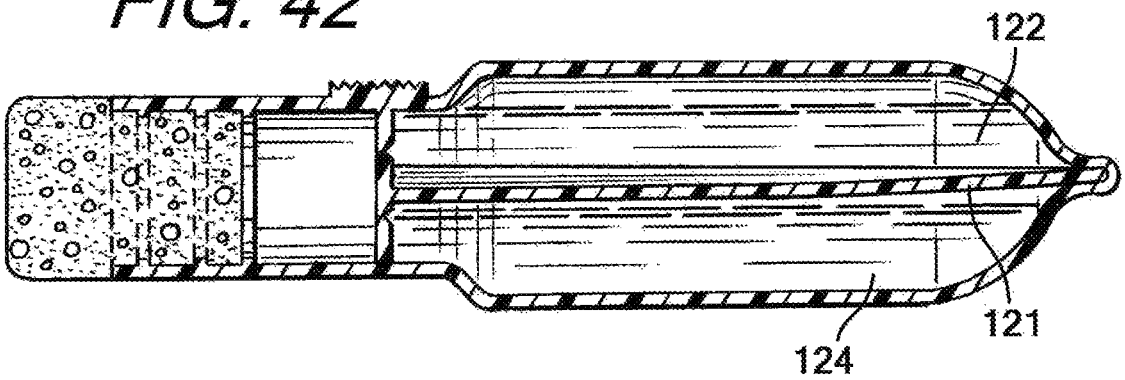
Figure 43:
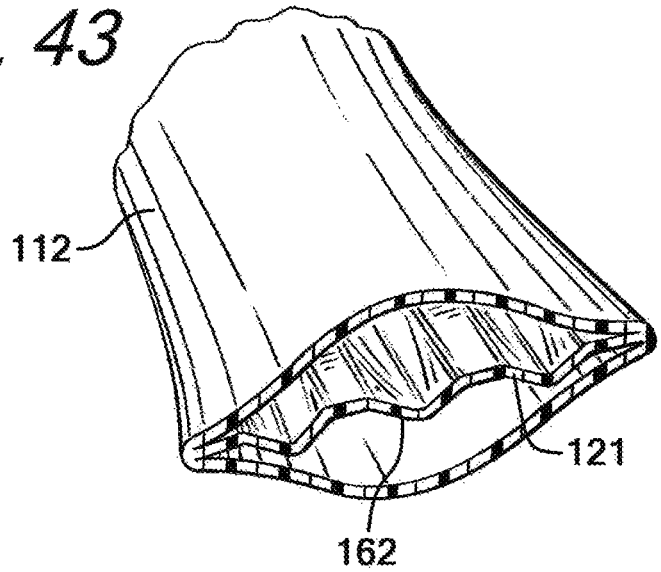
Figure 44:
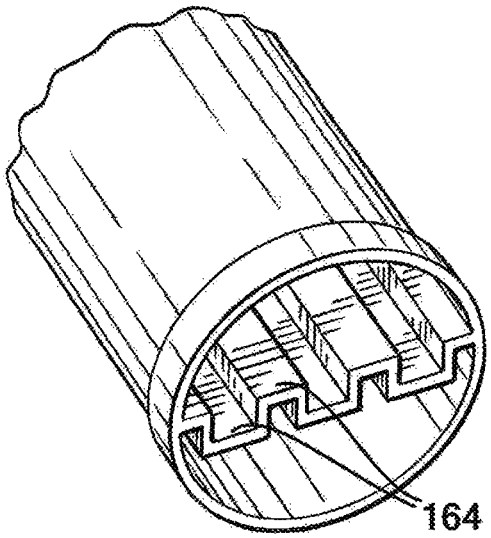
Figure 45:
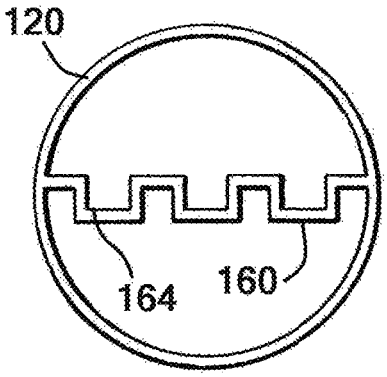
Figure 46:
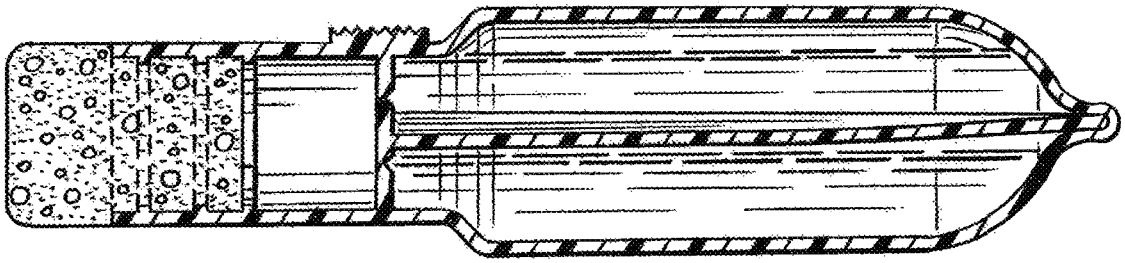
Figure 47:
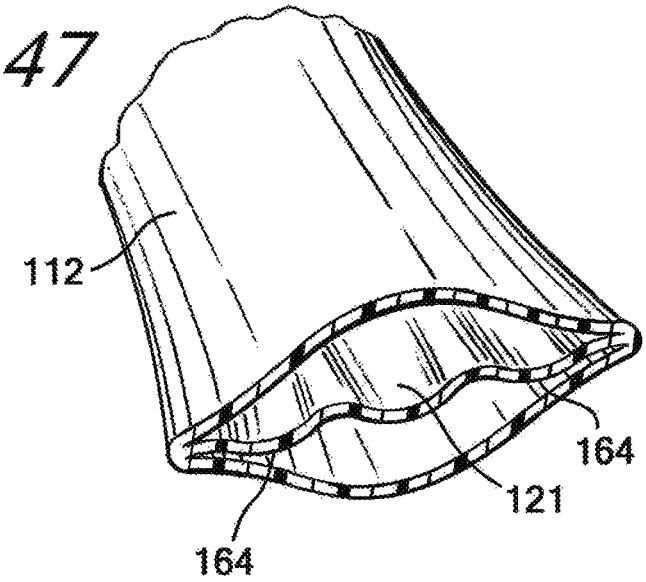
Figure 48:
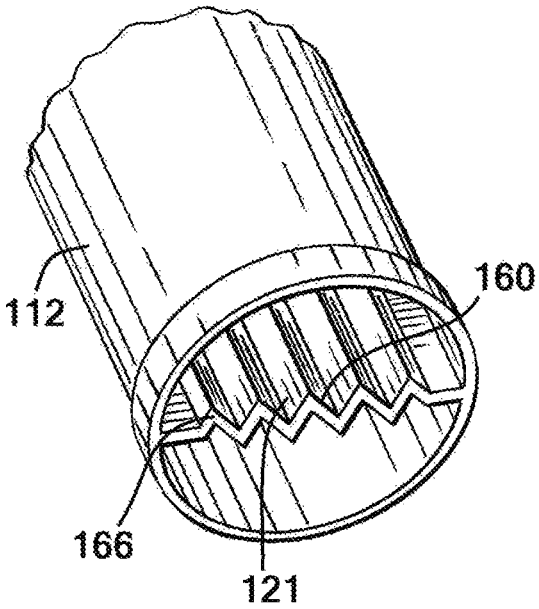
Figure 49:
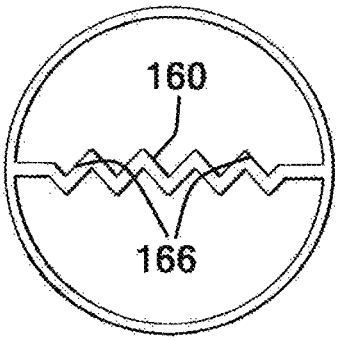
Figure 50:
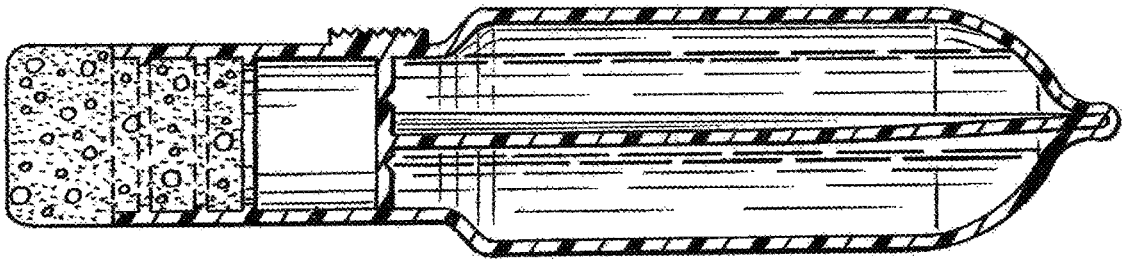
Figure 51:
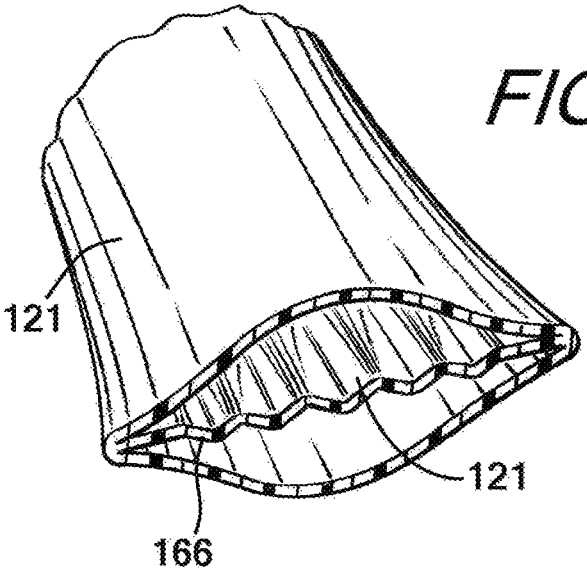
Figure 52:
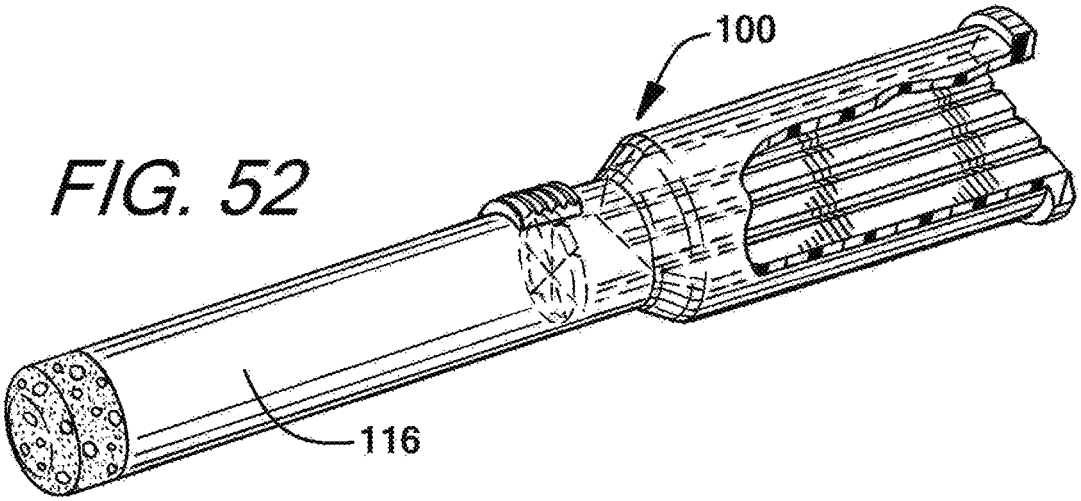
Figure 53:
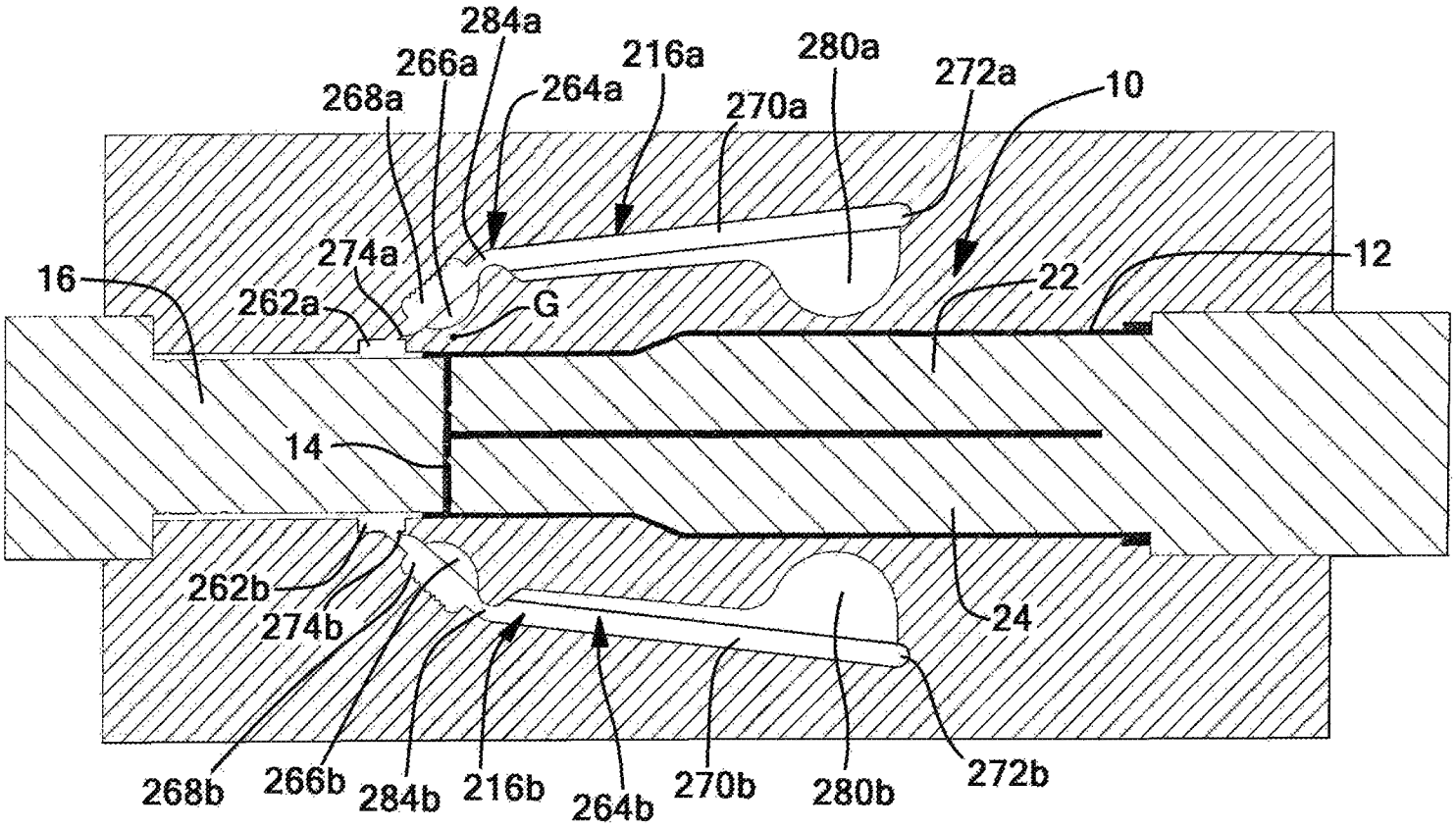
Figure 54:
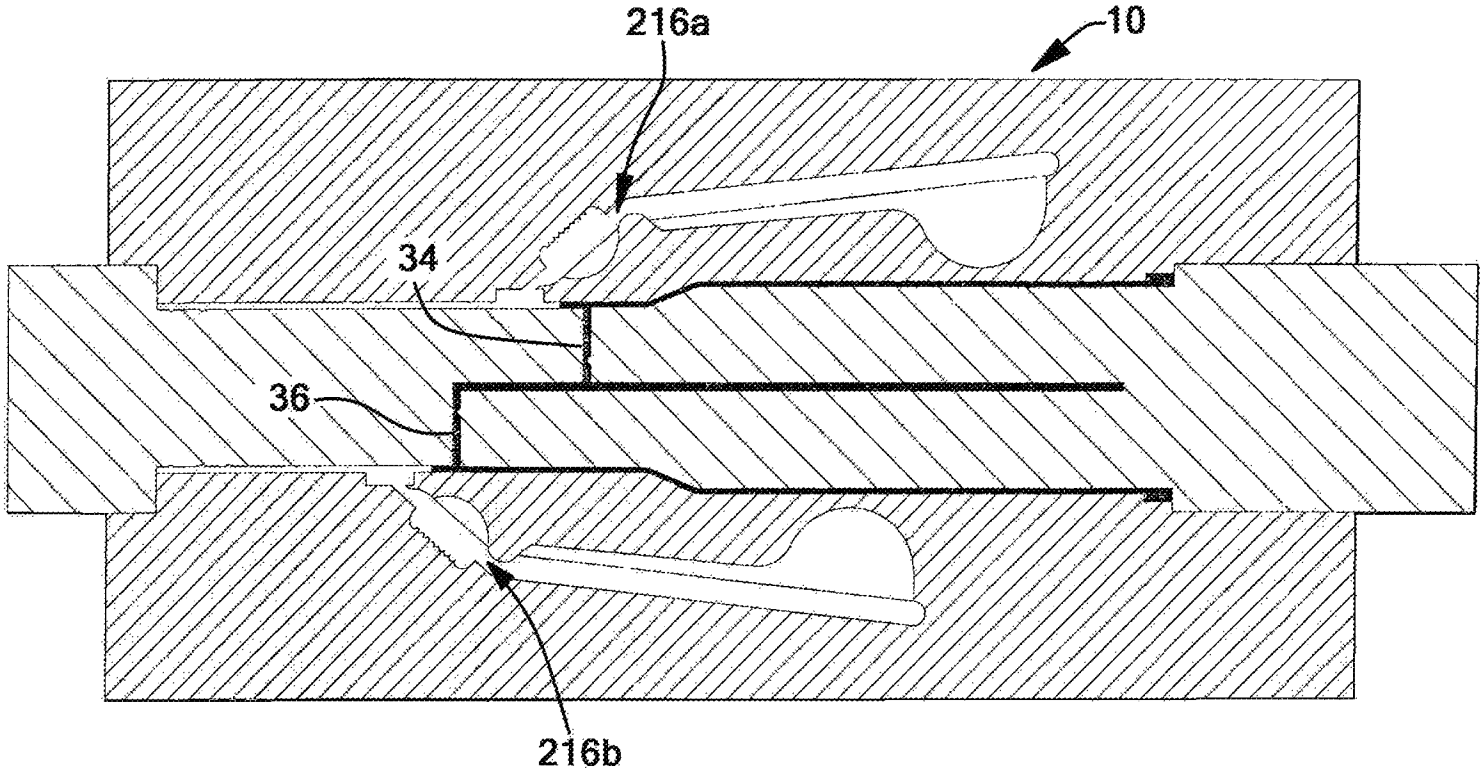

FIG. **16*a*-16*f*** are a series of views showing the injection molding process of the membrane wherein adjacent mold segments abut to form mold lines or weld seams;

FIG. 17 is a schematic view of the dispenser being filled with flowable substances by a filling apparatus;

FIG. 18 is a partial schematic view of a sealing apparatus for sealing a distal end of the dispenser to contain the flowable substances;

FIG. 19 is a cross-sectional view of the dispenser of the present invention holding two flowable substances;

FIG. 20 is a cross-sectional view of the dispenser showing a user rupturing sections of the membrane of the dispenser;

FIG. 21 is an end view of the dispenser having forces applied thereto wherein the membrane is fractured along weld seams defining openings through the membrane sections;

FIG. 22 is a cross-sectional view of the dispenser showing a user rupturing a first section of a membrane of the dispenser;

FIG. 23 is a cross-sectional view of the dispenser showing the user rupturing a second section of the membrane of the dispenser shown in FIG. 22, wherein a first flowable substance M1 mixes with a second flowable substance M2 to form a mixture;

FIG. 24 is a cross-sectional view of the dispenser shown in FIG. 21 wherein the mixture is dispensed from the dispenser;

FIG. 25 is a partial cross-sectional view of an alternative embodiment of the dispenser of the present invention;

FIG. 26 is a perspective view of another embodiment of the dispenser according to the present invention, and showing a membrane having offset membrane sections;

FIG. 27 is a cross-sectional view of the dispenser of FIG. 26, the dispenser separately storing a first flowable material and a second flowable material;

FIG. 28 is an enlarged partial cross-sectional view of an area indicated in FIG. 27 of a mixing chamber and membrane;

FIG. 29 is an end view of the membrane of the dispenser;

FIG. 30 is a perspective view of a core pin having an end face with a raised structure;

FIG. 31 is a schematic cross-sectional view of a mold and a portion of the material for forming the dispenser of FIG. 26;

FIG. 32 is a cross-sectional view of the dispenser of FIG. 26 showing a user rupturing sections of the membrane of the dispenser wherein a first flowable material M1 mixes with a second flowable material M2 to form a mixture;

FIG. 33 is a cross-sectional view of the dispenser shown in FIG. 32 wherein the mixture is dispensed from the dispenser;

FIG. 34 is a cross-sectional view of another embodiment of the dispenser of the present invention, the dispenser separately storing a first flowable material and a second flowable material, and having a slug of material in the mixing chamber;

FIG. 35 is a cross-sectional view of the dispenser of FIG. 34 showing a user rupturing sections of the membrane of the dispenser wherein a first flowable material M1 mixes with a second flowable material M2 and the slug of material to form a mixture, wherein the mixture is dispensed from the dispenser;

FIG. 36 is a cross-sectional view of another embodiment of the dispenser of the present invention, the dispenser having an offset membrane, the dispenser separately storing a first flowable material and a second flowable material, and having a slug of material in the mixing chamber;

FIG. 37 is a cross-sectional view of the dispenser of FIG. 36 showing a user rupturing sections of the membrane of the dispenser wherein a first flowable material M1 mixes with a second flowable material M2 and the slug of material to form a mixture, wherein the mixture is dispensed from the dispenser;

FIG. 38 is a perspective view of another embodiment of the dispenser of the present invention, the dispenser having a portion cut away to show a dividing wall of the dispenser;

FIG. 39 is a top view of the dispenser of FIG. 38 and having a portion cut away showing the dividing wall;

FIG. 40 is an end view of the dividing wall of the dispenser prior to a distal end of the dispenser being sealed;

FIG. 41 is a rear perspective view of the dispenser and having the distal end sealed, and further having a portion cut away to show the dividing wall;

FIG. 42 is a cross-sectional view of the dispenser of FIG. 38;

FIG. 43 is a partial cross-sectional view of the dispenser of FIG. 38 and showing the dividing wall after the distal end of the dispenser has been sealed;

FIG. 44 is a partial rear perspective view another embodiment of the dispenser of the present invention and having an alternative dividing wall configuration;

FIG. 45 is an end view of the dividing wall of the dispenser of FIG. 44 prior to a distal end of the dispenser being sealed;

FIG. 46 is a cross-sectional view of the dispenser of FIG. 44;

FIG. 47 is a partial cross-sectional view of the dispenser of FIG. 44 and showing the dividing wall after the distal end of the dispenser has been sealed;

FIG. 48 is a rear perspective view of another embodiment of the dispenser of the present invention and having an alternative dividing wall configuration;

FIG. 49 is an end view of the dividing wall of the dispenser of FIG. 48 prior to a distal end of the dispenser being sealed;

FIG. 50 is a cross-sectional view of the dispenser of FIG. 48;

FIG. 51 is a partial cross-sectional view of the dispenser of FIG. 48 and showing the dividing wall after the distal end of the dispenser has been sealed;

FIG. 52 is a perspective view of another embodiment of the dispenser of the present invention, the dispenser having a portion cut away to show a dividing wall of the dispenser, the dispenser further having an elongated mixing chamber similar to the dispenser of FIG. 1;

FIG. 53 is a schematic cross-sectional view of a mold and a portion of the material for forming an alternative embodiment of the dispenser of the present invention, the dispenser having a fracturing mechanism; and FIG. 54 is a schematic cross-sectional view of a mold and a portion of the material for forming another alternative embodiment of the dispenser of the present invention, the dispenser having a fracturing mechanism and an offset membrane.

DETAILED DESCRIPTION OF THE PREFERRED EMBODIMENT

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the drawings, FIG. 1 discloses a dispenser according to the present invention generally designated by the reference numeral 10. As described in greater detail below, the dispenser 10 generally includes a container 12 or container assembly 12, a rupturable or fracturable membrane 14, a mixing chamber 16 and in certain exemplary embodiments, an applicator assembly 18.

Figure 2:
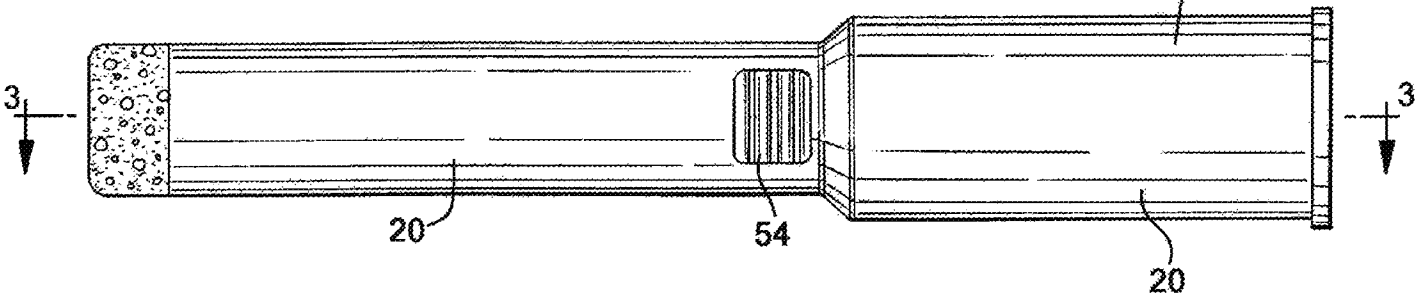
FIG. 2 is a top plan view of the dispenser of FIG. 1 prior to sealing a distal end of the dispenser.
Figure 3:
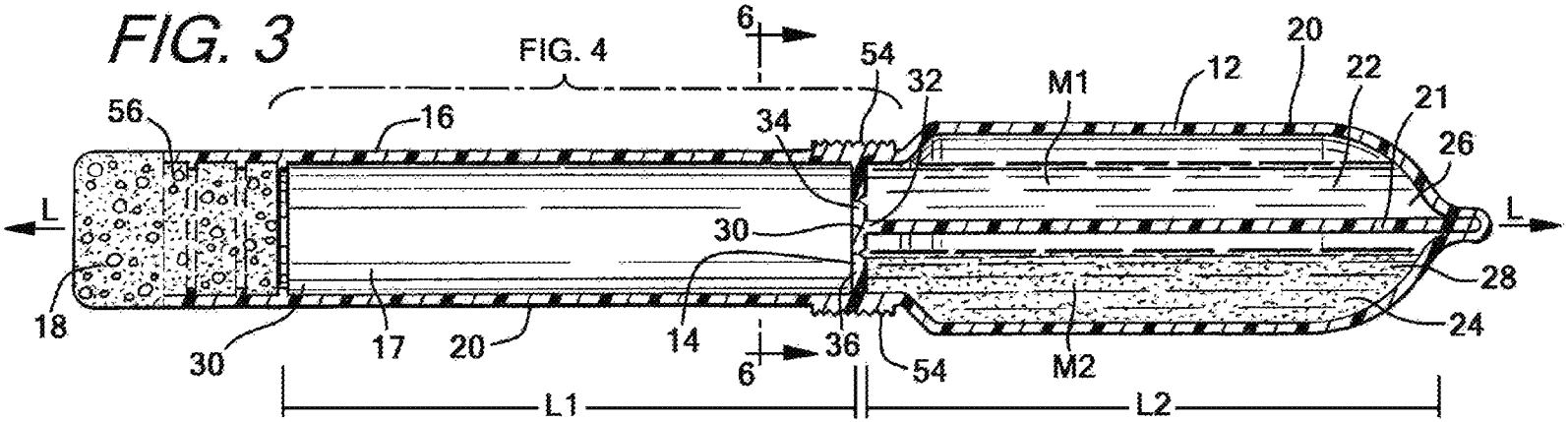
FIG. 3 is a cross-sectional view of the dispenser taken along lines 3-3 in FIG. 2.

FIG. 2 shows the container assembly 12 prior to having one end sealed as will be described in greater detail below. The container assembly 12 generally defines an elongated, longitudinal axis L (FIG. 3). In one preferred embodiment, the container assembly 12 is cylindrical. However, the container assembly 12 can be molded in numerous shapes, including an elliptical shape.

As further shown in FIGS. 2 and 3, the container assembly 12 generally comprises an outer wall 20 and a dividing wall 21 that cooperate with the fracturable membrane 14. The outer wall 20, the dividing wall 21, and the membrane 34 are preferably integral. As explained in greater detail below, the outer wall 20, the dividing wall 21 and the membrane 14 are operably connected to cooperatively define a first chamber 22 and a second chamber 24 as well as the mixing chamber 16, which may also be designated as a third chamber 16. As described in greater detail below, the outer wall 20 is dimensioned to further extend to define the mixing chamber 16.

While a three chamber dispenser is one preferred embodiment, more or less chambers can also be defined within the container assembly 12. Generally, to form additional chambers, additional chamber dividing walls 21 can be used. Some different chamber arrangements may include three chamber dividing walls that divide the flowable material containing portion of the dispenser into three chambers, or four chamber dividing walls that divide the flowable material containing portion of the dispenser into four chambers.

As shown in FIG. 3, the first chamber 22, which is adapted to contain a first flowable material M1 to be dispensed, has an interior surface, an exterior surface, and a distal end 26. The second chamber 24, which is adapted to contain a second flowable material M2, also has an interior surface, an exterior surface, and a distal end 28. The third chamber 16 has an interior surface and an exterior surface defined by the outer wall 20 and also a proximate end 30. As explained in greater detail below, the distal end 26 of the first chamber 18 and the distal end 28 of the second chamber 20 can be closed by a number of sealing methods, including heat or adhesive sealing. In such case as shown in FIG. 3, the distal ends 26,28 are sealed against an end of the dividing wall 21 to close the distal ends 26,28. Alternatively, the distal ends 26,28 can receive a cap to close the first and second chambers 18, 20. When the distal ends 26,28 are sealed, and in cooperation with the membrane 14, the first chamber 22 and second chamber 24 are closed chambers for holding flowable materials such as a two part medicinal mixture. As also shown in FIG. 3, if desired, the container 12 can be necked down wherein the third chamber 16 has a smaller diameter than the diameter of the combined first and second chambers 22,24. It is understood that the chambers can be sized as desired for various applications.

The chamber dividing wall 21 is positioned in between the first chamber 22 and the second chamber 24 as shown in FIG. 3, and is a generally planar member in an exemplary embodiment. The chamber dividing wall 21 has a sufficient thickness to divide and separate the chambers. The first and second chambers 22,24 can vary in length as desired. The chamber dividing wall 21 divides the first chamber 22 and the second chamber 24, and preferably joins to the membrane 14 at an interface at the membrane center point that defines a non-rupturable member 30 to be described further below. While the dividing wall 21 extends substantially the entire longitudinal length of the container, it is understood that the dividing wall 21 can extend past the outer wall 20 of the container 12 prior to sealing. This extension can assist in handling the container assembly 12 prior to filling. For example, this extended portion can be used by automation machinery used in the filling process of the dispenser 10. The dividing wall 21 divides the container assembly 12 generally evenly along its longitudinal axis L, making the first chamber 22 and the second chamber 24 generally of equal size. However, in some embodiments, the chamber dividing wall 21 does not bisect the membrane 14 into equal sections, and rather forms a first chamber and second chamber of different sizes and volumes.

Figure 4:
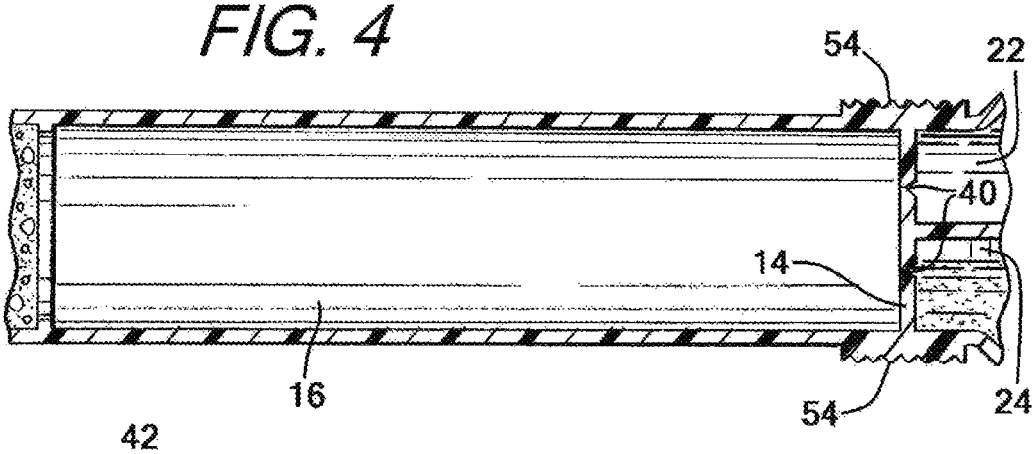
FIG. 4 is an enlarged partial cross-sectional view of an area indicated in FIG. 3 of a mixing chamber and membrane.
Figure 5:
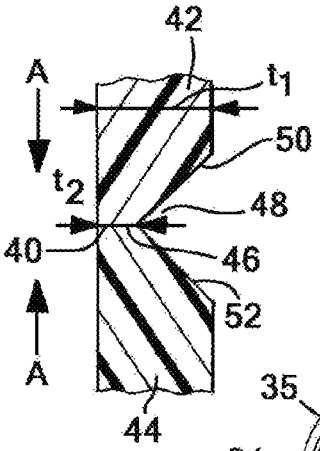
FIG. 5 is an enlarged partial cross-sectional view of the membrane showing a weld seam.
Figure 6:
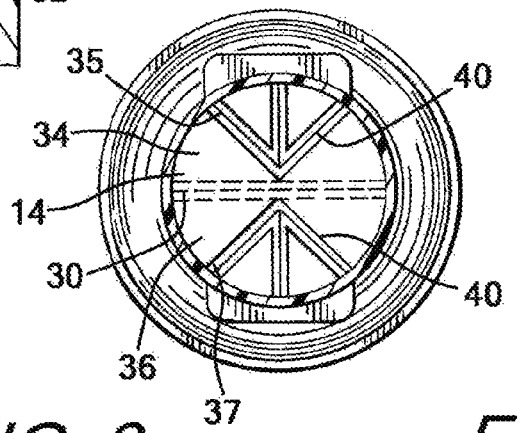
FIG. 6 is an end view of the membrane of the dispenser.

As shown in FIGS. 3-9, the chamber dividing wall 21 has a proximate end 32 that joins the membrane 14 and is preferably integral with the membrane 14 to define the non-rupturable member 30. In addition, the interface between the proximate end 32 of the dividing wall 21 and the membrane 14 defines the non-rupturable member 30. The non-rupturable member 30 is operably associated with the dividing wall 21. The non-rupturable member 30 of the membrane 14 extends across the diameter of the membrane 14 and is positioned generally at the center point of the membrane 14. The non-rupturable member 30 defines or separates a first section 34 of the membrane 14 having a first rupturable member 35 (or first fracturable member 35), and a second section 36 of the membrane 14 having a second rupturable member 37 (or second fracturable member 37). As shown in FIGS. 3 and 6, the membrane 14 includes the first section 34 that confronts and seals the first chamber 22 and the second section 36 that confronts and seals the second chamber 24. The division of the first section 34 of the membrane 14 from the second section 36 is the dividing wall 21 at the non-rupturable member 30 which divides the first chamber 22 from the second chamber 24.

As further shown in FIG. 6, the membrane 34 contains a plurality of rupturable members 35,37 preferably in the form of weld seams 40, which can be arranged in a number of configurations including but not limited to a cross, star, or asterisk. At least one weld seam 40 is located on each of the first section 34 and second section 36 of the membrane 14. For example, in one exemplary embodiment the first section 34 has the first rupturable member 35 that is a first weld seam 40, and the second section 36 has the second rupturable member 37 that is a second weld seam 40. It is understood, further, that the benefits of the invention can be realized with a single weld seam 40, in each of the membrane sections 34,36 formed from a pair of mold segments abutting one another. In a preferred embodiment, the weld seams 40 are collectively arranged in an asterisk configuration wherein the membrane has a pie-shape. As shown in FIG. 5, adjacent mold segments 42, 44 from an injection molding process abut with one another to form the weld seams 40. Due to the configuration of the mold to be described below, the weld seams 40 are formed to have a lesser thickness t2 than the membrane thickness t1. As further shown in FIG. 6, the plurality of weld seams 40 extend radially from substantially a midpoint of the non-rupturable member 30 on the membrane 14 completely to an outer edge of the membrane 14, and to the interior surface of the container assembly 12. It is understood, however, that the weld seams 40 do not need to extend to the outer edge of the membrane 34. It is also understood that the weld seams 40 of the first section 34 do not extend across the non-rupturable member 30 into the second section 36. It is also understood that the weld seams 40 of the second section 36 do not extend across the non-rupturable member 30 into the first section 34. Thus, the non-rupturable member 30 separates the first weld seams 40 from the second weld seams 40. While a membrane containing weld seams 40 is preferred, it is understood that the rupturable members can take other forms including frangible members or members formed by other processes, such as scoring, and are otherwise rupturable or fracturable.

Figure 15:
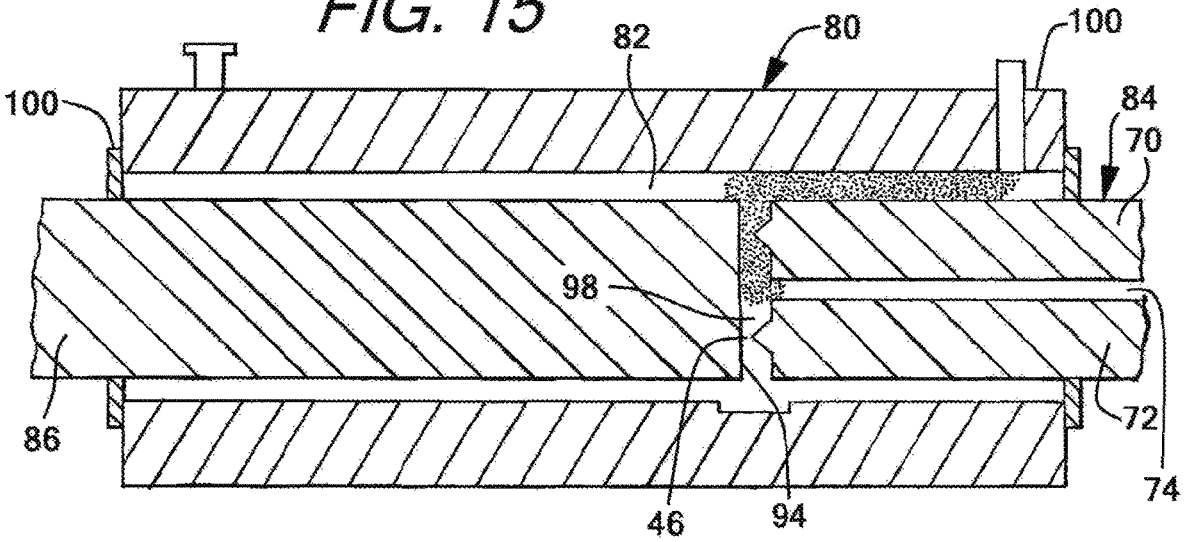
FIG. 15 is a schematic cross-sectional view of a mold and a portion of the material for forming the dispenser.
Figure 16A:
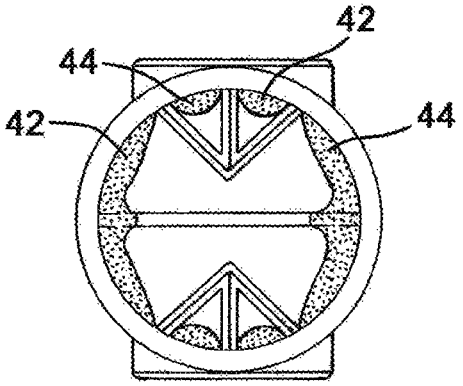
Figure 16B:
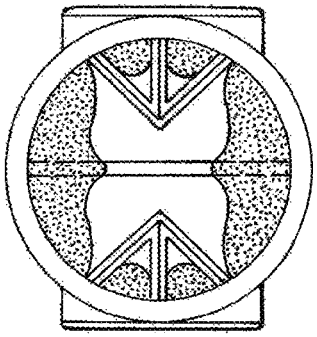
Figure 16C:
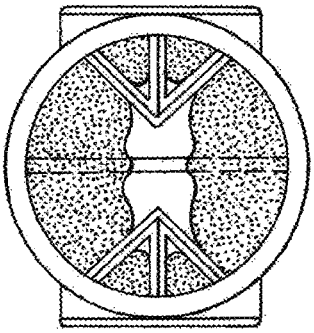
Figure 16D:
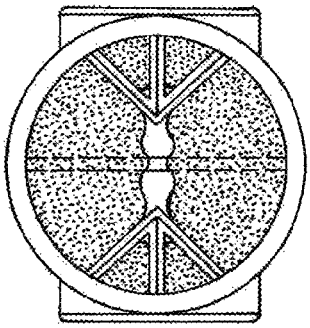
Figure 16E:
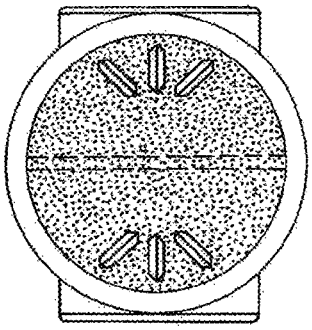
Figure 16F:
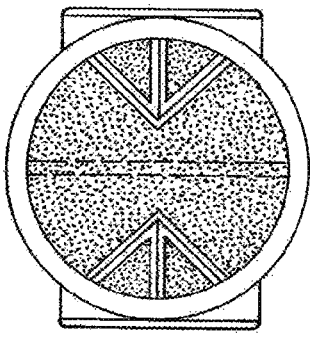

The membrane 14 formed is similar to the membrane structure disclosed in U.S. Pat. No. 6,641,319, which is incorporated herein by reference. In a most preferred embodiment, the membrane 14 has eight mold segments; four mold segments are located in the first section 34 and four mold segments are located in the second section 36. Each section 34,36 has at least a pair of mold segments 42,44. The four mold segments cooperate wherein adjacent mold segments abut at three separate interface areas to form three weld seams 40 in the first section 34 and three weld seams 40 in the second section 36. As shown in FIG. 15, the process is controlled such that the adjacent mold segments 42,44 each meet at the separate interface areas 46. Each weld seam 40 has a thickness t2 less than the thicknesses of the segments t1. The thicknesses of the mold segments are considered to be the membrane thickness t1 (FIG. 5).

Figure 7:
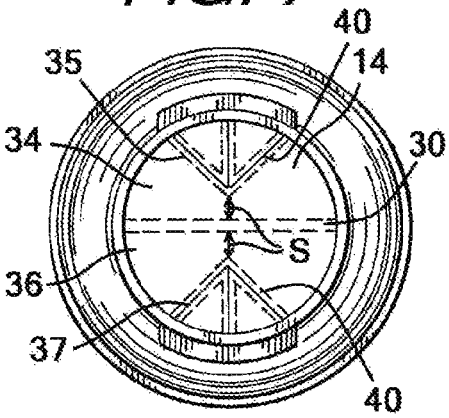
FIG. 7 is an end view of an alternative membrane of the dispenser.
Figure 8:
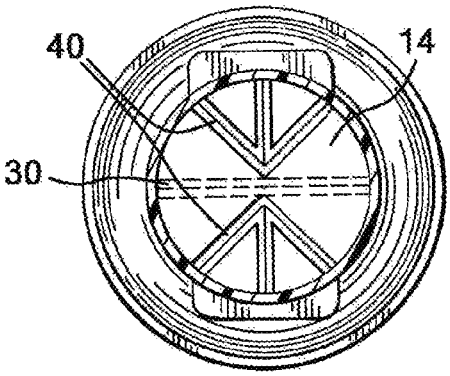
FIG. 8 is an end view of the membrane of the dispenser.
Figure 9:
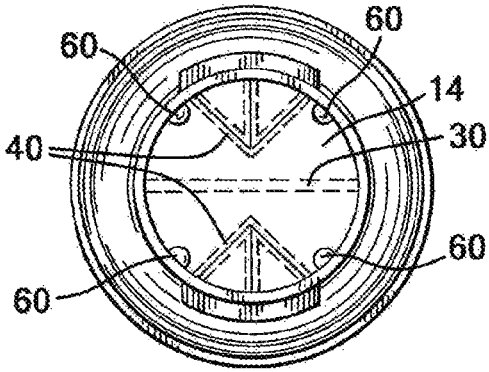
FIG. 9 is an end view of an alternative embodiment of the dispenser and showing longitudinal ribs.

FIG. 7 shows an alternative embodiment of the membrane 14 and configuration of the weld seams 40. In some exemplary embodiments, it is desirable to have the weld seams 40 of the membrane 14 converge to a point spaced from the non-rupturable member 30.

As can be appreciated from FIG. 7, the membrane 14 shown can be incorporated into the dispenser 10 and other descriptions in the application apply also to the membrane 14 shown in FIG. 7. The membrane 14 shown in FIG. 7 has the first section 34 that confronts the first chamber 22 and the second section 36 that confronts the second chamber 24. The dividing wall 21 is connected to the membrane 14 to define the non-rupturable membrane 30 that separates the first section 34 and the second section 36. The non-rupturable member 30 is similar in structure to the non-rupturable member 30 described above. As further shown in FIG. 7, the membrane 14 contains a plurality of rupturable members 35,37 preferably in the form of radial depressions or weld seams 40, similar to the welds seams 40 of FIG. 6 described in greater detail above. The membrane 14 is similar to the membrane structure disclosed in U.S. Pat. No. 6,641,319, which is expressly incorporated by reference herein. At least one weld seam 40 is located on each of the first section 34 and the second section 36 of the membrane 14. In one exemplary embodiment, the first section 34 has a first rupturable member 35 that is a first weld seam 40, and the second section 36 has a second rupturable member 37 that is a second weld seam 40. It is further understood that the benefits of the invention can be realized with a single weld seam 40, in each of the membrane sections 34,36 formed from a pair of mold segments abutting one another. As discussed above and shown in FIG. 5, adjacent mold segments 42,44 from an injection molding process abut one another to form the weld seams 40. Due to the configuration of the mold, the weld seams 40 are formed to have a lesser thickness t2 than the membrane thickness t1. FIG. 7 shows the plurality of weld seams 40 extending radially from substantially a midpoint located a distance S spaced away from the non-rupturable membrane 30, to an outer edge of the membrane 14. In each membrane section, the weld seams 40 extend generally from a point spaced away from the non-rupturable member 30, to proximate a periphery of the membrane. The distance S can vary as desired. In one preferred embodiment, it is understood that the weld seams 40 do not contact the non-rupturable member 30, nor do the weld seams 40 from one section extend across the non-rupturable member 30 into the other section. In the exemplary embodiment shown in FIG. 7, each membrane section has three weld seams 40 that converge to the point spaced (S) away from the non-rupturable member 30.

Compression of the container 12, such as by finger pressure, causes the membrane 14 to fracture, break or rupture only along the radial depressions or weld seams 40 forming a series of finger-like projections which are displaced in overlapping fashion (FIG. 21) to create membrane openings 41 for release of the flowable material from the first chamber 22 and the second chamber 24 into the third chamber 16. Since the projections are "pie-shaped" and widest at their outer edges, the center section of the web or membrane 14 breaks open the widest. The amount of material that can be dispensed through the web 14 is controlled by the degree of the opening 41. The size of the opening 41 is controlled by the configuration of the weld seams 40 and the pressure of the fingers of the user pressing on the container assembly 12 to assert pressure on the web 14. Fracturing of the membrane 34 will be described in greater detail below. The resiliency of the material of the dispenser 10 allows the membrane 14 to return substantially to a closed position when force is removed from the dispenser 10.

As further shown in FIGS. 3-7, the web 14, or membrane 14, partitions the container assembly 12 to separate the first chamber 22 and second chamber 24 from the third chamber 16. The placement of the membrane 14 is a function of the desired volume capacity of the respective chambers. As such, the membrane 14 could be located at numerous locations in the container assembly 12. In an exemplary embodiment that will be further described, the membrane 14 is positioned, and also based on the overall size of the container 12, to effectuate desired volume capacities of the first chamber 22, second chamber 24 and mixing chamber 16. In particular, the membrane 14 is positioned such that the volume of the mixing chamber 16 will be generally approximately equal to or greater than the collective volumes of the first chamber 22 and the second chamber 24. Alternatively, the mixing chamber 16 is dimensioned to be capable of receiving the collective volumes of the first flowable material M1 and the second flowable material M2.

As shown in FIGS. 3 and 4, the membrane 34 has a first surface and a second surface. The first surface faces towards the first and second chambers 18, 20, while the second surface faces towards with the third chamber 16. The second surface is substantially planar. The first surface, however, has a plurality of bands thereon formed by the weld seams 40. Also in one preferred embodiment, the membrane 14 is disposed substantially transverse to the elongated axis L of the container assembly 12. As will be described in greater detail below, and as generally shown in FIGS. 5, and 14-16, a first segment 42 of injected molded material abuts a second segment 44 of injected molded material to form the weld seam 40. As can be further seen in FIG. 5, the membrane 14 has a base thickness "t1" between the first membrane surface and the second membrane surface. The thickness t1 is generally referred to as the membrane thickness. The weld seam 40 has a thickness t2 that is less than the membrane thickness t1. This facilitates rupture of the membrane 14 as described below. The first mold segment 42 and the second mold segment 44 abut to form the weld seam 40. During the molding process, the mold segments 42,44 move toward the interface area 46 in the directions of arrows A (FIG. 5). Furthermore, the mold segments 42,44 meet substantially at the interface area 46 at the lesser thickness t2. This forms the weld seam 40 at the lesser thickness facilitating rupture of the membrane 14. If the mold segments 42,44 did not meet at the interface area 46 but, for example, substantially further to either side of the interface area 46, the weld seam 40 would be too thick and would not be able to rupture. Whichever mold segment 42,44 moved past the interface area 46, the segment would merely flex and not rupture as desired. Thus, as described below, the molding process is controlled to insure that the mold segments 42,44 abut substantially at the interface area 46 to form the weld seam 40 having a thickness t2 less than the membrane thickness t1. In addition, the mold and associated components are configured and the molding process controlled such that a weld seam is not formed at the non-rupturable member 30.

Explained somewhat differently, the first surface of the membrane 14 has a channel 48 formed therein (FIG. 7). The weld seam 40 confronts the channel 48. The channel 48 is formed by a first wall 50 adjoining a second wall 52. In a preferred embodiment, the first wall 50 adjoins the second wall 52 at substantially a 90 degree angle. Acute angles or obtuse angles are also possible. Thus, in one preferred embodiment, the channels are V-shaped.

In another preferred embodiment, the membrane 14 forms six narrow spokes of substantially uniform width extending from substantially the center of the membrane 34 to the interior surface of the container assembly 12. Each spoke extends at a certain angle from the adjacent spokes on either side. As shown in FIG. 6, because of the non-rupturable member 30, larger mold segments are formed at opposite sides of the membrane 14. A portion of each larger mold segment makes up a portion of the first section 34, and another portion of each larger molded segment makes up a portion of the second section 36.

As shown in FIGS. 1-4, the exterior surface of the container assembly 12 has exterior extension 54 to indicate the location where force should be applied to rupture the membrane 14. Specifically, a first extension 54 is located directly adjacent to the membrane 14 on one side of the container assembly 12 and a second extension 54 is located on generally an opposite side of the container assembly 12. Although the extensions 46 are shown as pads with a plurality of ridges, any type of raised area or projection including a button, prong or ring will suffice. In addition, a ring of material could be applied around the perimeter of the container assembly 12 corresponding to the location of the membrane 14 so that a user would know precisely where to apply finger pressure. An indicia-bearing marking would also be sufficient.

As shown in FIGS. 3 and 4, first chamber 22 and second chamber 24 are separated from the third chamber 16 by the membrane 14. The third chamber 16, or mixing chamber 16, is where the first flowable material M1 and second flowable material M2 combine to form a mixture MX (FIGS. 20, 24) to be dispensed. As can be appreciated from FIGS. 3 and 4, the outer wall 20 of the container assembly 12 extends a distance from the membrane location and opposite the first and second chamber 22,24. In an exemplary embodiment, the mixing chamber 16 is an integral portion of the container assembly 12. A proximal end of the mixing chamber 16 is generally adjacent to the membrane 14. The mixing chamber 16 has a main portion 17 that defines the volume of the mixing chamber 16. The mixing chamber 16 further has a distal extension end that defines an opening 56. The opening 56 at the distal end is dimensioned to receive the applicator 18. In an exemplary embodiment, the distal extension end of the mixing chamber 16 is not included as the main volume defining portion of the mixing chamber 16 where the flowable materials will be mixed. As further shown in FIG. 3, the mixing chamber has a plurality of circumferential ribs 58 proximate the distal end that cooperate with the applicator 18 as further described below. In an alternative embodiment shown in FIG. 9, the mixing chamber 16 may have longitudinal ribs 60 that cooperate with the applicator 18 as further described below.

As further shown in FIGS. 1-4, the outer wall 20 extends an elongated distance to form the mixing chamber 16 wherein the mixing chamber has an elongated length L1. In prior designs, any mixing chamber provided was of a truncated length and substantially lesser in length than the elongated length L1 shown in FIGS. 1-4. As shown in FIG. 3, the elongated length L1 of the mixing chamber is generally equal or substantially the same to the length L2 of the container assembly 12 defining the first chamber 22 and the second chamber 24. The length L1 generally does not included the distal extension end that received the applicator 18. In particular, the membrane 14 is positioned in the container assembly 12 such that the volume of the main portion of the mixing chamber 16 will be generally approximately equal to the collective volumes of the first chamber 22 and the second chamber 24. The mixing chamber 16 could also be greater than the collective volumes of the first chamber 22 and the second chamber 24. Alternatively, the mixing chamber 16 is dimensioned to be capable of receiving the collective volumes of the first flowable material M1 and the second flowable material M2. It is understood that the distal ends of the first and second chambers 22,24 could be varied and offset from one another to adjust respective volumes of the chambers 22,24, and the size or volume of the mixing chamber 16 will be dimensioned to be approximately equal to or greater than the collective volumes of the chambers 22,24, or sized to be capable of receiving all of the flowable materials M1,M2 stored in the chambers 22,24. As explained in greater detail below, the increased elongated length L1 and volume of the mixing chamber 16 promotes enhanced mixing of the flowable materials M1,M2. Prior designs had small mixing chambers wherein there is an increased chance that the materials would not be sufficiently mixed prior to being dispensed from the dispenser 10. The mixing chamber 16 may be an elongated cylindrical tube like structure.

As shown in FIGS. 3 and 4, the interior surface of the distal extension of the third chamber, include the plurality of ribs or projections. In one preferred embodiment, the ribs may take the form of circumferential ribs 58. As shown in an alternative embodiment of FIG. 9, the interior surface of the distal extension has a plurality of longitudinal ribs 60 that extend longitudinally along the interior surface. The ribs 60 are thus oriented axially in the third chamber 42 and can be of varying length. The ribs 58,60 could be shortened and extend radially inwardly. The ribs 58,60 secure different applicators 18, such as a swab 62 (FIG. 10) or dropper 64 (FIG. 11), a brush assembly 66 (FIG. 12), or a roller assembly 68 (FIG. 13) which can be used to apply the dispensed liquid or solid flowable material. The different applicators form an interference fit with the ribs 58,60. The applicators 18 could also be dimensioned to fit over the distal end of the mixing chamber 16 if desired. The different applicators 18 are in communication with the third chamber 16 as shown in FIGS. 10-13. It is understood that other applicators 18 are also contemplated.

Figure 10:
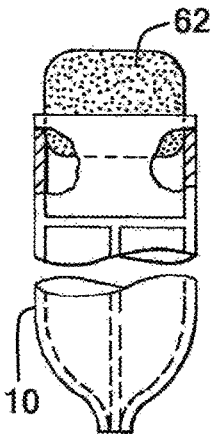
FIG. 10 is a partial elevation view of the dispenser supporting a swab assembly.

As further shown in FIG. 10 the swab 62 engages the inner surface of the third chamber 16. Once the membrane 14 is fractured as described, the swab 62 receives and absorbs the materials M1 and M2 as they are dispensed from the first and second chambers 22,24 and mixed into the third chamber 16. The swab 62 has a contact surface that is used to dab a desired area such as a skin surface having an insect bite and being cleaned and prepared for a surgical incision. The dispenser 10 can be inverted and squeezed until the swab 62 surface is wet. The dispenser 10 can then be held in a vertical position with the swab 62 pointed upwardly. Alternatively, the swab 62 can be made of a material of relatively large porosity for passing droplets through the swab 62 by gravity and for dispensing droplets from its exterior surface. The swab 62 can be made of polyester, laminated foamed plastic, cotton or the like. As explained in greater detail below, the dispenser 10 can be shaken or agitated to aid in sufficiently mixing the flowable materials M1,M2 that are fully received in the mixing chamber 16.

Figure 11:
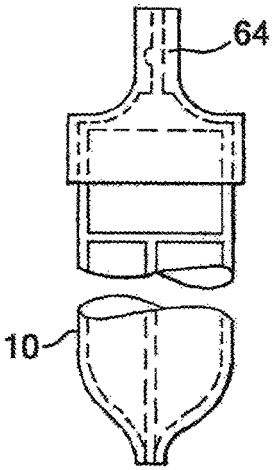
FIG. 11 is a partial elevation view of the dispenser supporting a dropper assembly.
Figure 12:
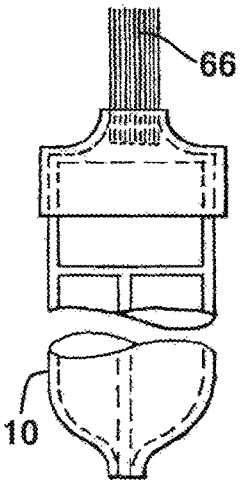
FIG. 12 is a partial elevation view of the dispenser supporting a brush assembly.
Figure 13:
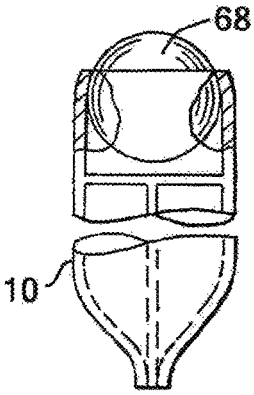
FIG. 13 is a partial elevation view of the dispenser supporting a roller assembly.

FIG. 11 shows the dispenser 10 having a dropper attachment 64. The third chamber 42 has a dropper 64 attached thereto. The dropper 50 has an elongated spout with a passageway for dispensing droplets of the mixed materials. The dropper 64 has a cup-like portion that overlaps a portion of the outer surface of the third chamber 16. Once the membrane 14 is ruptured as described and materials M1 and M2 pass from the first and second chambers 22,24 to the third chamber 16, droplets of the mixed M1 and M2 materials can be dispensed through the spout. The dispenser 10 can be similarly manipulated to dispense the flowable materials M1, M2 using the different applicators of FIGS. 11-13.

In a preferred embodiment, the dispenser 10 is made of a transparent, flexible thermoplastic material. The preferred plastic material is polyethylene or polypropylene but a number of other plastic materials can be used. For example, low-density polyethylene, polyvinyl chloride or nylon copolymers can be used. In a preferred embodiment, a mixture of polypropylene and polyethylene copolymer or thermoplastic olefin elastomer is used. In another preferred embodiment, a mixture of polypropylene and Flexomer®, available from Union Carbide, is utilized. The dispenser is made of material which is flexible enough to allow sufficient force to rupture the membrane 14. Also, in a preferred embodiment, the dispenser is a one-piece integrally molded member.

The dispenser 10 could also be formed from additional materials. In an exemplary embodiment, the dispenser 10 is made of thermoplastic material. The material could be transparent, translucent or opaque. The preferred plastic material is polyethylene or polypropylene but a number of other plastic materials can be used. For example, low-density polyethylene, polyvinyl chloride or nylon copolymers can be used. In a preferred embodiment, a mixture of polypropylene and polyethylene copolymer or thermoplastic olefin elastomer is used. In another preferred embodiment, a mixture of polypropylene and Flexomer® (very low density polyethylene resins—VLDPE), available from Dow Chemical, is utilized. In addition, low density polyethylene with linear low density polyethylene can be used. It is essential that the dispenser be made of material which is flexible enough to allow sufficient force to rupture the membrane 14. Also, in a preferred embodiment, the dispenser is a one-piece integrally molded member.

Due to the enhanced features of the dispenser described herein, additional blends of polyethylene and polypropylene can be used that could not previously be used due to limitations such as in the molding capabilities of the materials in forming the dispenser or rupturability of the weld seams once the membrane is formed. For example, blends with an increased amount of polypropylene can be used with the angled or conical membrane as the membrane can be readily ruptured, and such blends further provide increased chemical resistant properties. With increased chemical resistance, the dispenser can be used to contain a wider variety of flowable substances. In prior designs utilizing such percentages of polypropylene, the membrane was not capable of being ruptured via finger pressure. A dispenser made solely of nylon is also possible.

The dispensers of the present invention could further be formed from other material formulations or compositions. In one particular exemplary embodiment, the dispenser is formed in the injection molding process wherein the process utilizes a further unique thermoplastic formulation. In particular, the process utilizes a unique formulation of polyethylene, polypropylene and polyvinylidene fluoride (PVDF) resin. The polyvinylidene fluoride provides for increased chemical resistance which allows the dispenser to contain a surgical prep solution (antiseptic solution) such as a chlorhexidine gluconate based solution, or CHG-based solution. In one exemplary embodiment, the formulation used for the dispenser 10 is a certain predetermined proportion of polyethylene, a certain predetermined proportion of polypropylene and a certain predetermined proportion of polyvinylidene fluoride. In another exemplary embodiment, the formulation used for the dispenser 10 is a certain predetermined proportion of polypropylene and a certain predetermined proportion of polyvinylidene fluoride. In other exemplary embodiments, the dispenser can be made entirely from polypropylene or the dispenser can be made entirely from polyvinylidene fluoride. It is understood that other components or additives could be incorporated depending on desired applications for the dispensers. It is further understood that these potential material formulations can be incorporated for any of the dispenser embodiments disclosed herein.

Still further materials can be used to form the dispenser in exemplary embodiments of the present invention. For example, the dispenser can be made from 100% nylon including 100% medical grade nylon. The dispenser could also be made from 100% polypropylene. The dispenser could also be made from 100% high density polyethylene, or 100% polyethylene. In a further exemplary embodiment, the dispenser can be made from 100% polyvinylidene fluoride. Prior testing by the inventor showed that these materials are all highly chemically-resistant and suitable for containing certain types of surgical prep solutions such as chlorohexidine gluconate (CHG). Testing of dispensers made from such materials and holding CHG showed that they could meet the required shelf-life requirements for commercial distribution and sale. The CHG solutions could also include cyano-acrylic used with CHG to seal out contaminants. These materials, however, are more stiff and typically could not be used in an injection molded container using a membrane with a weld seam. With the present invention, however, a thicker weld seam is possible and even with a more stiff material, the fracturing mechanism allows the user to put more force onto the membrane to fracture the membrane than forces from squeezing via hand pressure directly on the container wall such as in prior embodiments.

The preferred dispenser 10 has a length of about 1.5 to about 3.0 inches, although larger containers can be utilized, with 2 to about 2.5 inches being preferred. The container could also be approximately 3 to 6 inches, or even 5 to 10 inches. The outside diameter of the container assembly is about 0.30 to about 1.0 inches. The mixing chamber may be in varying ranges and in some exemplary embodiments, the mixing chamber may have a length in the range of approximately 3 inches to 6 inches. In certain embodiments, for example, the mixing chamber may be about 3 inches and the first and second chambers may be about 3 inches wherein the dispenser is about 6 inches long. It is understood that if an applicator is utilized, this can add to the overall length.

The exterior extension 46 is preferably about 0.10 to about 0.50 inches in width and about 0.010 to 0.125 inches thick. The third chamber 42 is preferably about a length equal to or greater than the length of the container that defines the chambers holding the flowable materials prior to mixing in certain exemplary embodiments. The membrane 14 preferably has a thickness of about 0.02 to about 0.0625 inches. The weld seams 40 have a preferable thickness of about 0.003 to about 0.008 inches and preferably about 0.005-0.006 inches. The above dimensions can be varied depending upon overall dispenser size.

Figure 14:
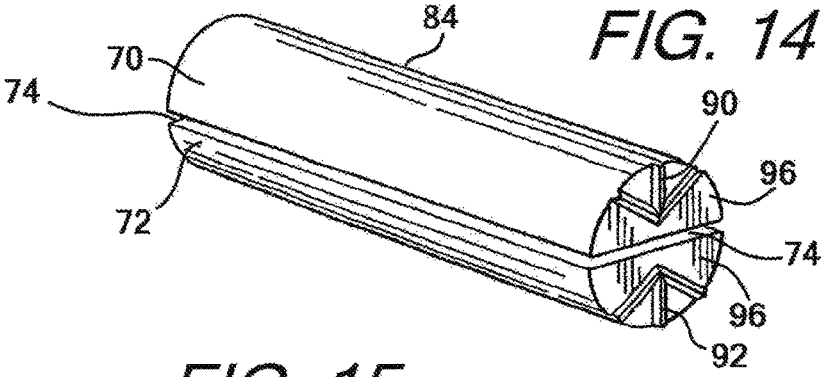
FIG. 14 is a perspective view of a core pin having an end face with a raised structure.

The method of making the dispenser 10 is generally illustrated in FIGS. 14-16 and is similar to the process described in U.S. Pat. Nos. 6,641,319 and 7,976,234. The dispenser 10 is produced in a single molding operation thus providing a one-piece injected-molded part. As shown in FIG. 15, a mold 80 is provided having a mold cavity 82 therein. The mold cavity 82 is dimensioned to correspond to the exterior surface of the dispenser 10. A first core pin 84 and a second core pin 86 are provided. A first core pin 84 (FIG. 14) has a first leg 70 and a second leg 72 separated by a longitudinal slot 74 or elongated recess 74. The first leg 70 has a first raised structure 90 and the second leg 72 has a second raised structure 92. Each raised structure 90,92 could be different. The core pin 84 is dimensioned to correspond to the interior surface of the dispenser 10. It is understood that the core pin could have a shoulder to form the tapered portion, or necked-down portion of the dispenser 10. Alternatively, the core pin could have a constant diameter if there is to be no tapered portion (different core pin options shown in FIGS. 14-15).

As shown in FIG. 15, the second core pin 86 has a generally planar end face 94. However, the first core pin 84 has an end face 96 on the first leg 70 and the end face 96 on the second leg 72 having the raised structures 92 thereon. The raised structures 90,92 are in the form of ridges. The ridges are what provides for the depressions or weld seams 40 at the certain thickness in the membrane 14. In a preferred embodiment, the ridge has a first wall adjoining a second wall to form a line. The ridges on the end face 96 are generally the same, although they can be different in alternative embodiments. Furthermore, in a preferred embodiment, the ridge comprises a plurality of ridges radially extending substantially from a center point of the end faces. The ridges define a plurality of membrane segments, or mold gaps, between the ridges. Thus, it can be understood that the raised structure 90 in the form of the ridges provides the corresponding structure of the membrane 14. Although shown as triangular, the ridges can be formed in a number of shapes, including square or rounded. In addition, the ridges can be arrayed in a multitude of shapes, including a single line, a cross, a star, or an asterisk. Varying the shape of the ridges will affect the shape of the channels.

The first leg 70 and the second leg 72 of the first core pin 84 can each be semi-cylindrical in shape. When properly positioned for the molding process the first leg 70 and the second leg 72 have the elongated recess or longitudinal slot 74 between them. During molding, the longitudinal slot 74, or elongated recess 74 is generally filled with molten material which forms the chamber dividing wall 21 upon cooling. In other embodiments the first and second core pins can each be semi-elliptical or various other shapes. The interface of material between the dividing wall 21 and the membrane 14 defines the non-rupturable member 30.

The first core pin 84 is inserted into the mold 80 with the raised structure 90 facing into the mold cavity 82. A first space is maintained between the mold 80 and the length of the first core pin 84. The second core pin 86 is also inserted into the mold cavity 82 wherein a second space is maintained between the mold 80 and the second core pin 86. The core pins 84, 86 are generally axially aligned wherein the end faces 96 of the first core pin 84 confronts the end face 94 of the second core pin 86 in spaced relation. Thus, a membrane space 98 is defined between the respective end faces 94,96 of the core pins 84 and 86. The longitudinal slot 74 is defined between the first leg 70 and the second leg 72 of core pin 84. End plates 100 are installed on end portions of the mold 80 to completely close the mold. An exterior extension cavity is located on the surface of the mold 80 and adjacent to a membrane space 108. Additional exterior extension cavities could be provided to the mold to correspond to the number of extensions on the dispenser 10.

As shown schematically in FIG. 15, molten thermoplastic material is injected into the mold cavity 82 through an inlet. The material flows into the first space, second space, membrane space 94, and elongated recess 74. The plastic injection is controlled such that the plastic enters the membrane space 94 simultaneously in the circumferential direction. The raised structures 90,92 separate the material into separate mold segments 42,44 that flow into the mold gaps. As shown in FIGS. 15 and 16, the mold segments 42,44 flow first into the wider portions of the mold gaps as this is the area of least resistance. The material continues to flow into the membrane space 94 and then the adjacent mold segments 42.44 abut at the interface area 46 to form the weld seams 40. As can be appreciated from FIG. 15, the weld seams 40 have a lesser thickness than the membrane thickness. The first raised structure 90 of the first leg 70 forms the first weld seam 40, and the second raised structure 92 of the second leg 74 forms the second weld seam 400. During this process, air is vented from the mold cavity 82 as is conventional.

Once the plastic injection is complete, the material is allowed to cool. A cold water cooling system could be utilized wherein cold water is pumped into the mold 80 outside of the cavity 82 if desired. Once cooled, the dispenser 10 can be removed from the mold 80.

As shown in FIG. 17, the dispenser 10 can be passed on to a filling apparatus 120. The dispenser 10 is then filled with flowable materials M1 and M2. As previously discussed, the extended portion of the dividing wall 19 could be manipulated by automation machinery associated with the filling apparatus 120. As shown in FIG. 18, the distal end of the dispenser 10 is sealed by heat sealing dies 198. The excess end portion can then be cut-off and discarded. It is understood that heat sealing is one preferred seal while other sealing methods could also be utilized.

Thus, a one-piece injection molded dispenser is provided. The one-piece construction provides a more repeatable part and at greater manufacturing efficiency than providing a separate piece that is secured into a container assembly. If desired, however, the membrane 14 could be separately molded and affixed into a container assembly 12. A one-piece molding process, however, is preferred. In addition, because the membrane 14 is molded to have the weld seams, radial depressions, or bands, an additional manufacturing step such as scoring to create a rupturable member is unnecessary. This allows the manufacture of dispensers having relatively small diameters since there is no need to allow sufficient clearance for a scoring tool. In such small configurations, it is difficult to control the scoring operation. By forming the depressions by injection molding, the desired thicknesses can be closely controlled. The membrane 14 also resists rupture from hydraulic pressure while being easily rupturable when forces are applied to the membrane. Also, the construction of the membrane 14 allows for the precise control of material to be dispensed by controlling the amount of force on the membrane 14. It is further understood that the depressions or channels could be formed on both sides of the membrane 14 if desired. In such configuration, however, the ability of the membrane to also function as a check valve is lessened. In a preferred embodiment, however, the membrane has the depressions molded on only one side. It is further understood while certain dimensions are preferred for certain embodiments, dispensers of all sizes having similar relative dimensions can be formed according to the present invention. It is also understood that in certain embodiments of the multi-chambered dispenser, the rupturable member could be other than a weld seam if desired. For example, a scored line could be provided, a frangible seam, or other rupturable member.

FIGS. 19-24 disclose operation of the dispenser 10 after being filled and sealed as shown in FIGS. 17 and 18. Thus as shown in FIG. 19, in an exemplary embodiment, an integral one-piece injection molded dispenser is provided that separately stores the first flowable material M1 and the second flowable material M2. A desired applicator 18 may be operably connected to the distal end of the mixing chamber 16.

In operation, when it is desired to mix the flowable materials M1,M2 to create a mixture to be dispensed, a user applies a selective force F on the dispenser 10 at the exterior extensions 54 adjacent to the membrane 14. When sufficient force F is applied, as shown in FIG. 20, lateral pressure is applied to the membrane 14 causing the membrane 14 to fracture, shear or rupture along the weld seams 40. The membrane 14 ruptures only along the weld seams 40 to create the membrane openings 41 as shown in FIG. 21. Upon rupture of the membrane 14, material M1,M2 passes from the first chamber 22 and the second chamber 24 through the membrane 14 and into the mixing chamber 16. The material flow rate through the membrane 14 and into the third chamber 16 or mixing chamber 16 is controlled by the degree of membrane opening which is directly related to the amount of force F applied to the membrane 14 by the user. Therefore, the user can precisely regulate the flow of material after rupture of the membrane 14. In addition, the membrane 14 can preferably have elastic characteristics wherein when force F is removed, the membrane 14 returns substantially to its original position. While the weld seams 40 may be ruptured, the segments 42,44 can form a close enough fit to prevent material from flowing past the membrane 14 without additional pressure on the material. Thus, the membrane 14 can act as a check valve to prevent unwanted flow of the material back into the chambers 22,24.

In one preferred embodiment it is understood that a user can apply a selective force F on the dispenser 10 at the exterior extensions 54 adjacent to the membrane 14 causing the first section 34 of the membrane 14 to rupture along the first weld seams 40 of the first section 34 of the membrane 14 as shown in FIG. 20. Upon rupture of the first weld seams 40 of the first section 34 of the membrane 14, the first flowable material M1 passes from the first chamber 22 through the first section 34 of the membrane 14 and into the mixing chamber 16. As a user applies a selective force F at the exterior extension 54 adjacent to the membrane 14, the force causes the second section 36 of the membrane 14 to rupture along the second weld seams 40 of the second section 36 of the membrane 14. Upon rupture of the second weld seams 40 of the second section 36 of the membrane 14, the second flowable material M2 passes from the second chamber 24 through the second section 36 of the membrane 14 and into the mixing chamber 16 as shown in FIG. 20. The first flowable material M1 and the second flowable material M2 mix within the mixing chamber 16 to form a mixture MX. As discussed, the elastic characteristics of the membrane 14 allow the membrane 14 to close.

As discussed, the length of the outer wall 20 of the container assembly 12 that defines the, mixing chamber 16 is dimensioned such that the volume of the mixing chamber 16 is at least equal to or greater than the collective volumes of the first chamber 22 and the second chamber 24. As the dividing wall 21 divides the first chamber 22 and the second chamber 24, the portion of the container wall 20 defining the mixing chamber 16 is approximately equal in length to the portion of the container wall 20 defining the first chamber 22 and the second chamber 24. The membrane 14 is positioned generally proximate a midportion of the overall length of the container wall 20. With generally equal volumes between the mixing chamber 16 and the first and second chambers 22,24, the mixing chamber 16 is capable of receiving the entire contents M1,M2 of the chambers 22,24. As such, the first flowable material M1 and the second flowable material M2 can fully mix to form the mixture MX in the mixing chamber 16. Thus, as all of the contents of the flowable materials M1,M2 are contained in the mixing chamber 16, the dispenser 10 can be shaken and agitated by the user to assist in mixing the contents. This volume structure of the mixing chamber 16 assists in making sure the mixture MX is sufficiently mixed and forms as desired. The mixture MX saturates the applicator 18 and can be dispensed from the dispenser 10. In prior designs, and mixing chamber provided were smaller in size wherein sufficient mixing was a challenge.

The mixture MX is subsequently dispensed from the mixing chamber such as shown in FIG. 24. As discussed, while FIG. 24 shows a swab type applicator, other applicators could also be used.

In some embodiments, it is desirable to have one section of the membrane 14 to fracture before another section of the membrane 14. For example, as shown in FIG. 22, a user selectively applies force first to the extension 54 proximate the first section 34 of the membrane 14 wherein the weld seams 40 fracture and the flowable material M1 passes through the membrane 14 and into the mixing chamber 16. As shown in FIG. 23, the user selectively applies force to the extension 54 proximate the second section 36 of the membrane 14 wherein the weld seams 40 fracture and the flowable material M2 passes through the membrane 14 and into the mixing chamber 16. It is understood that the thickness of the respective weld seams 40 in the first and second membrane sections can be varied with respect to each other to help control which membrane section will fracture first. As shown in FIG. 24, the first flowable material M1 and the second flowable material M2 mix in the mixing chamber 16 to form the mixture MX. As discussed, as shown in FIG. 24, the mixing chamber 16 are dimensioned such that the volume of the mixing chamber 16 is at least equal to or greater than the collective volumes of the first chamber 22 and the second chamber 24. Alternatively, the volume of the mixing chamber 16 is sized to be capable of fully receiving the full stored amounts of the first flowable material M1 and the second flowable material M2. With such dimensions as described, all of the contents can be received in the mixing chamber 16 wherein the user can shake the dispenser 10 to sufficiently create the mixture MX as desired.

In additional exemplary embodiments, it may be desirable for the first section 34 of the membrane 14 rupture before the second section 36 of the membrane 14. In this embodiment, the thickness t2 at the weld seam 40 on the first section 34 of the membrane 14 is less than the thickness t2 at the weld seam 40 on the second section 36 of the membrane 14. When pressure is applied to the exterior of the dispenser 10, the first section 34 of the membrane 14 ruptures, and then the second section 36 of the membrane 14 ruptures. Alternatively, pressure could be withdrawn such that only the first section 34 ruptures, leaving the second section 36 intact and to be subsequently ruptured.

FIG. 25 discloses a further alternative embodiment of the dispenser 10 of the present invention. The general structure of the dispenser 10 is the same as previously described. The membrane 14, however, can have angle membranes in each of the first membrane section 34 and the second membrane section 36. In an exemplary embodiment, each section of the membrane generally forms an angled or conical membrane shape. It is understood that the membrane sections will have a fracturable member such as a weld seam 40.

FIGS. 26-33 show an alternative exemplary embodiment of the dispenser according to the present invention. The dispenser is similar in structure to the dispenser of FIGS. 1-24 and is also designated with the reference numeral 10 and similar structures will be referenced with like reference numerals. The previous description of the dispenser 10 of FIGS. 1-24 is applicable to this alternative embodiment and the description will focus more on the differences and additional features of this embodiment. Similar to the previous embodiment, the dispenser 10 generally includes a container 12, a membrane 14, a mixing chamber 16 and an applicator 18.

As further shown in FIGS. 26-28, the dispenser 10 includes the dividing wall 21, and the membrane 14 also includes the first membrane section 34 and the second membrane section 36. The membrane 14 in this exemplary embodiment is an off-set membrane. The first membrane section 34 is located at a different position than the second membrane section 36. Thus, the first membrane section 34 is offset from the second membrane section 36. The first and second membrane sections 34,36 are connected and integral with the dividing wall 21 at different longitudinal positions along the dividing wall 1419. The first membrane section 34 may also be considered to be operably associated with or connected to the second membrane section 36 by an interface segment 23. The interface segment 23 may be considered to be in line with the dividing wall and having one end connected to the first membrane section 34 and another end connected to the second membrane section 36. With the offset positions of the first membrane section 34 and the second membrane section 36, the respective volumes of the first chamber 22 and the second chamber 24 are different. In the embodiment shown in FIGS. 26-28, the volume of the second chamber 24 is greater than the volume of the first chamber 22. It is understood that the positions of the first membrane section 34 and the second membrane section 36 could be varied wherein the volume of the first chamber 22 is greater than the volume of the second chamber 24. With an offset membrane 14 creating different volumes of the chambers 22,24, the dispenser 10 can be used for additional applications that require such volume requirements with the flowable materials M1,M2 being mixed.

The dispenser 10 further includes the mixing chamber 16. The mixing chamber 16 has an elongated configuration as described above. Thus, the volume of the mixing chamber 16 is generally equal to or greater than the combined volumes of the first chamber 22 and the second chamber 24. Although the volume of the first chamber 22 and the second chamber 24 are different, the mixing chamber 16 is dimensioned to have a volume to be at least equal to or greater than the collective volumes of the first chamber 22 and the second chamber 24.

Similar to the previous embodiment, FIG. 29 shows an alternative embodiment of the membrane that can be incorporated into the dispenser 10 of FIGS. 26-28. The weld seams 40 are configured to be spaced from the non-rupturable member 30. Other structures and features of the membrane are similar as previously described.

FIGS. 30 and 31 disclose a core pin 150 and a schematic view of a mold used to form the dispenser 10 of FIGS. 26-28 having the offset membrane 14. The core pin 150 has offset leg structures to correspond to the offset membrane sections 34,36. The core pin 150 also has a planar portion 151 that cooperates with an opposite core pin to form the interface segment 23. It is understood that the mating core pin in the mold shown in FIG. 31 also has an offset structure to cooperate with the core pin 150. The description above regarding the formation of the dispenser 10 in the injection molding process is applicable to the disclosure in FIGS. 30-31. It is understood that the dispenser having an offset membrane 14 could have a mixing chamber that does not have an elongated configuration if desired.

FIGS. 32-33 show operation of the dispenser 10. It is understood that the first chamber 22 is filled with the first flowable material M1, and the second chamber 24 is filled with the second flowable material M2. Because of the off-set membrane design, the volumes of the first chamber 22 and the second chamber 24 are different. Certain applications may require mixtures to be formed from separately stored flowable materials M1,M2 in different quantities in order to achieve the desired mixture MX. Thus, one of the flowable materials M1,M2 may be required in a greater quantity than the other flowable material M1,M2. In this design, the flowable material that is required in a greater quantity can be stored in the chamber having the larger volume. The distal end of the container 12 is sealed against the dividing wall 21 to seal the first chamber 22 and the second chamber 24. The first flowable material M1 is thus separately stored from the second flowable material M2. A user applies force to the container wall 20 proximate the membrane 14 such as between a finger and thumb of the user. The user can decide whether to fractionate the first membrane section 34 or the second membrane section 36 first. The order of the fractionation of the membrane sections 34,36 may be dictated by the type of flowable materials M1,M2 being used to form the mixture MX. The first membrane section 34 fractionates along the weld seam 40 allowing the first flowable material M1 to pass through and into the mixing chamber 16. The second membrane section 36 fractionates along the weld seam 40 allowing the second flowable material M2 to pass through and into the mixing chamber 16. The first flowable material M1 and the second flowable material M2 mix together in the mixing chamber 16. As discussed, the length of the container wall 20 that defines the mixing chamber 16 is dimensioned such that the volume of the mixing chamber 16 is at least equal to or greater than the collective volumes of the first chamber 22 and the second chamber 24. The mixing chamber 16 can also be dimensioned to be capable of receiving the entire collective volumes of the first flowable material M1 and the second flowable material M2. As the dividing wall 21 divides the first chamber 22 and the second chamber 24, the portion of the container wall 20 defining the mixing chamber 16 is approximately equal in length to the portion of the container wall 20 defining the first chamber 22 and the second chamber 24. The membrane portions 34,36 are positioned generally proximate a middle area of the overall length of the container wall 20. With generally equal volumes between the mixing chamber 16 and the first and second chambers 22,24, the mixing chamber 16 is capable of receiving the entire contents M1,M2 of the chambers 22,24. As such, the first flowable material M1 and the second flowable material M2 can fully mix to form the mixture MX in the mixing chamber 16. This volume structure of the mixing chamber 16 assists in making sure the mixture MX is sufficiently mixed and forms as desired. The mixture MX saturates the applicator 18 and can be dispensed from the dispenser 10 as shown in FIG. 33.

The embodiments of the dispenser 10 are ideal for applications requiring the separate storage of multiple components that need to be mixed at a desired time and dispensed from the dispenser. In certain additional applications, a third material or additional material may be required to also mix with the first flowable material M1 and the second flowable material M2. FIG. 34 discloses the dispenser 10 having a first flowable material M1 and a second flowable material M2. The dispenser 10 also has an additional material M3 positioned in the mixing chamber 16. The additional material M3 is inserted into the mixing chamber prior to the applicator 18 being connected to the opening of the mixing chamber 16. The additional material M3 can take various forms such as a slug SL of material M3, a pellet M3 or some other form of reactive agent that is selected to cooperate with the first flowable material M1 and the second flowable material M2. As shown in FIG. 35, the user fractures the membrane 14 as previously described. The first flowable material M1 and the second flowable material M2 pass through the membrane 14 and into the mixing chamber 16 wherein the first flowable material M1, the second flowable material M2 and the additional material M3 all mix to form the mixture MX that is dispensed from the dispenser 10. FIGS. 36 and 37 show the dispenser of FIGS. 26-28 having the offset membrane. Additional material in the form of a slug of material M3 can also be incorporated into this dispenser 10 wherein all of the components M1,M2 and M3 mix to form the mixture MX and be dispensed as shown in FIG. 37. In a further alternative embodiment, the additional material M3 could also be incorporated in the applicator 18. For example, the applicator 18 could be impregnated with the additional material M3. In yet a further alternative embodiment, the additional material M3 could be included in the mixing chamber 16 and the applicator 18 is also impregnated with further additional material. Such a configuration may be used when a mixture MX is desired that requires four different components to be mixed.

FIGS. 38-52 show additional alternative exemplary embodiments according to the present invention. FIGS. 38-43 show a dispenser that is similar in structure to the previous dispensers 10 and is designated with the reference numeral 100. Similar structures will be referenced with like reference numerals in the 100 series. Similar to the previous embodiments, the dispenser 100 generally includes a container 112, a membrane 114, a mixing chamber 116 and an applicator 118. The dispenser 100 further has the dividing wall 121. In the exemplary embodiment shown in FIGS. 38-43, the mixing chamber 116 has a smaller dimension and defining a volume that is lesser than the collective volumes of the first chamber 122 and the second chamber 124. As discussed in greater detail below, the dividing wall 121 has certain structures to enhance operability of the dispenser 100.

FIGS. 38-41 shows the dividing wall 121 of the dispenser 100. The dividing wall 121 generally extends between the opposite sides of the container wall 120. In an exemplary embodiment, the dividing wall 121 has a plurality of undulations 160 or interruptions laterally across the dividing wall 121. The undulations 160 also extend along the longitudinal length of the dividing wall 121 in an exemplary embodiment as shown. It is understood that the undulations 160 do not have to extend entirely across the lateral portion of the dividing wall 121 or entirely along the longitudinal length of the dividing wall 121. It is further understood that a single undulation 160 could be utilized although a plurality of undulations 160 are utilized in an exemplary embodiment. In prior embodiments, the dividing wall 121 was a generally flat planar wall. The undulations 160 provide a more wavy, rippled, bent, or folded-type or otherwise interrupted surface. The undulations 160 provide varying elevations across the dividing wall 121. The undulations 160 provide additional material to the construction of the dividing wall 121 which allows the dividing wall 121 to expand or extend during sealing of the distal end of the dispenser 100 to be described in greater detail below.

The undulations 160 can take a plurality of different forms. FIGS. 38-41 shows the dividing wall 121 having undulations 160 in the form of notch undulations 162 in one exemplary embodiment of the invention. FIG. 40 shows an end view profile of the dividing wall 121. The undulations 160 take the form of a plurality of notches 162 across the dividing wall 121. The notches 162 extend along the longitudinal length of the dividing wall 121. The notches 162 converge to a point or apex wherein the notches are separated by a plurality of generally planar portions of the dividing wall 121 as can be appreciated from FIG. 40. After the first and second chambers 22,24 are filled, the distal end of the dispenser 100 is sealed such as by heat-sealing. During sealing, the undulations 160 allow the dividing wall 121 to expand or extend laterally wherein the notches 162 become more flattened or less undulated. This relieves stresses in the dividing wall 1419 when sealing. Undue stresses in the dividing wall 121 in prior designs having a flat planar wall can result in buckling of the dividing wall 121 leading to operational issues with the dispenser. FIG. 43 shows a partial cross-sectional view of the dispenser taken proximate the sealed distal end and showing the undulations 160 or notches 162 in an extended or expanded configuration. The notches 162 become less deep upon sealing as compared to the notches 162 in a pre-sealed configuration such as shown in FIG. 40.

FIGS. 44-47 show another embodiment of the dividing wall 121 that can be used in the dispenser 100. In this exemplary embodiment, the undulations 160 are generally U-shaped notches 164 that extend across the dividing wall 121. The U-shaped notches 164 also extend longitudinally along the dividing wall 121. The U-shaped notches 164 also allow the dividing wall 121 to expand or extend when the dispenser 1410 is sealed. For example, FIG. 47 shows a partial cross-sectional view of the dispenser taken proximate the sealed distal end and showing the undulations 160 or U-shaped notches 164 in an extended or expanded configuration. The U-shaped notches 164 become less deep upon sealing as compared to the notches 164 in a pre-sealed configuration such as shown in FIG. 45.

FIGS. 48-51 show another embodiment of the dividing wall 121 that can be used in the dispenser 100. In this exemplary embodiment, the undulations 160 are generally zigzag shaped notches 166 that extend across the dividing wall 121. The zigzag shaped notches 166 also extend longitudinally along the dividing wall 121. The zigzag notches 166 are alternating segments that provide multiple elevations of the dividing wall 121. The zigzag shaped notches 166 also allow the dividing wall 121 to expand or extend when the dispenser 100 is sealed. For example, FIG. 51 shows a partial cross-sectional view of the dispenser taken proximate the sealed distal end and showing the undulations 160 or zigzag shaped notches 166 in an extended or expanded configuration. The zigzag shaped notches 166 become less deep upon sealing as compared to the notches 166 in a pre-sealed configuration such as shown in FIG. 49.

FIG. 52 shows an additional exemplary embodiment of the dispenser of the present invention. The dispenser is generally similar to the dispenser 100 shown in FIG. 38. The dispenser in FIG. 52 utilizes an elongated mixing chamber 116 such as described above with respect to FIGS. 1-37 It is understood that the dispenser 52 could also have an offset membrane 14.

FIGS. 53-54 disclose additional alternative embodiments of the dispenser of the present invention. FIGS. 53-54 show the dispensers schematically as being formed in a mold cavity formed by mold members. The structure of the dispensers can be understood from FIGS. 53-54 and in conjunction with the descriptions regarding the other figures herein.

The dispenser of FIG. 53 is similar to the dispenser 10 shown in FIGS. 1-24. Similar structures will be referred to with like reference numerals. The description regarding the dispenser 10 of FIGS. 1-24 generally apply to the dispenser 10 of FIG. 53. Thus, the dispenser 10 has the container having the membrane 14 having a weld seam 40 and the first chamber 22, the second chamber 24 and the mixing chamber 16. As further shown in FIG. 53, the dispenser 10 further has a fracturing mechanism 216. While a single fracturing mechanism 216 can be used, the dispenser has a first fracturing mechanism 216*a* and a second fracturing mechanism 216*b* as shown in FIG. 53. In an exemplary embodiment, it is understood that the fracturing mechanisms 216*a*, 216*b* are integral with the container 12. The fracturing mechanism 216 is operably connected and associated with the container 12 and membrane 14 and functions to rupture the membrane 14. As will be described in greater detail below, a user can activate the fracturing mechanism 216 to fracture the membrane 14 of the dispenser 10 and dispense the contained flowable materials M from the dispenser 10.

In an exemplary embodiment, the fracturing mechanism 216 includes the first fracturing mechanism 216*a* and the second fracturing mechanism 216*b*. (It will be understood that the components of the fracturing mechanisms 216 will be referenced to the corresponding portions of the mold in FIG. 53 wherein the structures are formed.) The first fracturing mechanism 216*a* has a first base 262*a*, a first extending member 264*a* and a first projection 266*a*. The second fracturing mechanism 216*b* has a second base 262*b*, a second extending member 264*b* and a second projection 266*b*. The components of the first fracturing mechanism 216*a* and the second fracturing mechanism 216*b* are generally symmetrical and similar in structure. The structures of the first fracturing mechanism 216*a* will be described with the understanding that the description also applies to the second fracturing mechanism 216*b*.

As further shown in FIG. 53, the first base 262*a* is positioned on the outer wall 20 adjacent to but proximate the membrane 14. The first base 62*a* extends from the outer wall 20 and preferably follows the curved contour of the outer wall 20. The first base 262*a* is preferably integral with the container 12. The first base 262*a* is dimensioned to provide sufficient support for the first extending member 264*a*. As discussed, the above description applies to the second base 262*b*. The first base 262*a* provides a foundation for support of the extending member 264*a*.

FIG. 53 further shows the first extending member 264*a* and the second extending member 264*b*. The first extending member 264*a* and the second extending member 264*b* are generally symmetrical and similar in structure. The structures of the first extending member 264*a* will be described with the understanding that the description also applies to the second extending member 264*b*. The first extending member 264*a* has a generally elongated length as will be described in greater detail below. The first extending member 264*a* defines a first segment 268*a* and a second segment 270*a*. The first segment 268*a* extends away from the first base 262*a* and generally at an angle from the central longitudinal axis defined by the container 12. The second segment 270*a* extends from the first segment 268*a* and extends generally parallel to the longitudinal axis. The first segment 268*a* and the second segment 270*a* have generally smooth planar surfaces to define a platform for a user's thumb and/or fingers during operation as described in greater below. The length of the first segment 268*a* and the second segment 270*a* are dimensioned such that a distal end 272*a* of the second segment 270*a* extends to and is proximate a midportion of the overall length of the dispenser 10. The length of the first segment 268*a* and the second segment 270*a* could vary as necessary to achieve desired operation of the dispenser. As discussed, the description of the first extending member 264*a* applies to the second extending member 264*b* as the members 264*a*,264*b* are similar in structure.

As further shown in FIG. 53, the first projection 266*a* is positioned generally between an inner surface of the first extending member 264*a* and the container 12. The first projection 266*a* thus occupies a space defined between the container 12 and the first segment 268*a* of the first extending member 264*a*. The first projection 266*a* is a finger-like member positioned between the first extending member 264*a* and the container 12. The first projection 266*a* extends in a direction generally parallel to the longitudinal axis of the dispenser 10. The first projection 266*a* has a length wherein portions of the first projection 266*a* extend on both sides of the membrane 14. The first projection 266*a* further has a contoured surface in an exemplary embodiment. In an exemplary embodiment, the first projection 266*a* depends from the first segment 268*a* and is spaced from the container 12 to define a gap G when the first extending member 64*a* is in a first or neutral position. The gap G is thus initially maintained when the dispenser is in a neutral position prior to fracturing of the membrane. The gap G assists in minimizing inadvertent fracturing of the membrane 14 as there is a distance (the gap G) that the extending member 264*a*,264*b* can move before the outer wall 20 is engaged at the membrane 14. Thus, fracturing the membrane 14 requires a more deliberate action by the user. The description of the first projection 266*a* applies to the second projection 266*b* of the second extending member 264*b*.

As further shown in FIG. 53, a first hinge 274*a* is defined in an underside of the first segment 68*a*. The first hinge 274*a* is positioned generally adjacent the first base 262*a* and adjacent the first projection 266*a*. The first hinge 274*a* is positioned generally between the first base 262*a* and the first projection 266*a*. The first hinge 274*a* assists in activating the dispenser 10 as further described below. The first hinge 274*a* is defined by a cut-out portion generally in an end of the first segment 268*a* of the first extending member 264*a*. In an exemplary embodiment as shown, the cut-out portion may be in the form of a notched structure including a generally v-shaped notch. Other structures are possible such as a more cut-out portion defining a more contoured inner surface. As discussed, the first hinge 274*a* of the first ending member 264*a* and the first hinge 274*b* of the second extending member 264*b* are similar in structure and this description applies to the first hinge 274*b* of the second extending member 264*b*. In an alternative embodiment, the first hinge 274*a*,274*b* could be positioned on an outer surface of the first segment 268*a*,268*b*. The first hinge 274*a*,274*b* could also be formed from cut-out portions in an outer surface and an underside surface of the first segment 268*a*,268*b*. The first hinge 274*a*,274*b* provides for enhanced pivoting of the first extending member 264*a* and the second extending member 264*b*. It is further understood that the first extending member 264*a* can have a second hinge 284*a* generally at an interface area between the first segment 268*a* and the second segment 270*a*. The second hinge 284*a* enhance pivoting of the second segment 270*a*. It is understood that the second extending member 264*a* also can have a second hinge 284*b*.

As further shown in FIG. 53, the second segment 270*a* has a first depending rib 280*a* that extends from an inside surface of the second segment 270*a*. The first depending rib 280*a* has a contoured surface and a greater length towards the distal end 272*a* of the second segment 270*a*. The first depending rib 280*a* cooperates with the outer wall 20 of the container 12 during activation as will be described in greater detail below. As explained in greater detail herein, the depending ribs 280*a*,280*b* can have varying alternative structures as desired to enhance operability of the dispenser 10. For example, the depending ribs 280*a*,280*b* could have a greater amount of material that depends at proximate a distal end of the ribs 280*a*,280*b* wherein the ribs 280*a*,280*b* taper towards their respective first segments of the extending members.

As further shown in FIG. 53, the first rupturing mechanism 216*a* is positioned proximate the membrane 14 and at a first position on the container 12. The second rupturing mechanism 216*b* is positioned proximate the membrane 14 and at a second location on the container 12. In an exemplary embodiment, the second rupturing mechanism 216*b* is positioned generally opposite the first rupturing mechanism 216*a*. The first rupturing mechanism 216*a* is positioned generally 180° from the second rupturing mechanism 216*b*. The first rupturing mechanism 216*a* and the second rupturing mechanism 216*b* may also be positioned and spaced at other radial locations about the container 12.

Operation of the dispenser 10 can be appreciated from FIG. 53 and the prior descriptions herein. It is understood that the dispenser 10 is filled and sealed as described. In operation, a user applies a selective force F on the dispenser 10 at desired locations on the dispenser 10. The user grasps the dispenser 10 where a thumb is positioned on the first extending member 264*a* and a finger such as a forefinger is positioned on the second extending member 264*b*. The user squeezes the thumb and forefinger to apply force to the membrane 14. In particular, the user may place a thumb on the first extending member 264*a* and a finger is positioned on the second extending member 264*b*. It is understood that the user can place the thumb and finger on the respective first segments 268*a*,268*b* or the second segments 270*a*,270*b* or a combination. In response to the squeezing motion of the user, the first projection 266*a* and the second projection 266*b* move towards one another to a second position wherein the outer wall 20 is deflected, and wherein a force F is applied to the membrane 14 wherein the weld seams 40 on the first section 34 of the membrane 34 rupture to provide the opening through the membrane section 34 and the weld seams 40 on the second section 36 of the membrane 14 rupture to provide the opening through the second membrane section 36. The first hinge 274*a* assists in the pivoting motion of the first segment 268*a* of the first extending member 264*a*, and the first hinge 274*b* assists in the pivoting motion of the first segment 268*b* of the second extending member 264*b*.

With deflection of the first extending member 264*a* and the second extending member 264*b*, sufficient force F is applied to deflect the outer wall 20 wherein force F is transmitted to the membrane sections 34,36 causing the membrane 14 to fracture, rupture or shear along the weld seams 40. The membrane 14 ruptures only along the weld seams 40 to create the membrane openings. Upon rupture of the membrane 14, material passes from the first chamber 22, the second chamber 24 and into the mixing chamber 16. The material flow rate through the membrane 14 and into the mixing 16 is controlled by the degree of membrane opening which is directly related to the amount of force F applied to the membrane 14 by the user. Therefore, the user can precisely regulate the flow of material after rupture of the membrane 14. In addition, the membrane 14 can preferably have elastic characteristics wherein when force F is removed, the membrane 14 returns substantially to its original position. While the weld seams 40 may be fractured, the segments can form a close enough fit to prevent material from flowing past the membrane 14 without additional pressure on the material. Thus, the membrane 14 can act as a check valve to prevent unwanted flow of the material back into the chambers 22,24.

As the flowable material M continues to pass through the membrane 14, the flowable materials mix form a mixture that can be dispensed from the dispenser 10. Thus, a user can apply the flowable material M to a desired location.

It is understood that the dispenser 10 may be used to dispense various flowable materials in the form of liquids such as surgical prep solutions as described herein. The structures of the first extending member 264*a* and the second extending member 264*b* provide for enhanced operation such as when the flowable materials M1,M2 are a more viscous material that may not freely flow past the membrane 14 and through the applicator 18. The second segment 270*a* of the first extending member 264*a* and the second segment 270*b* of the second extending member 264*b* can be used to assist in forcing the flowable materials M1,M2 from the chambers 22,24 and ultimately through the applicator 18. As can be appreciated from FIG. 53, the user can further press on the second segments 270*a*,270*b* such as proximate the distal ends 272*a*,272*b* of the extending members 264*a*,264*b*. As the user presses the second segments 270*a*,270*b* towards one another, the first depending rib 280*a* and the second depending rib 280*b* contact opposite portions of the outer wall 20 of the container 12 and deflect the outer wall portions inwards towards one another. In such movements, the first depending rib 280*a* of the first extending member 264*a* and the first depending rib 280*b* of the second extending member 264*b* engage the outer wall 20 of the container 12 to deflect portions of the outer wall 20 toward one another. Such deflection of the outer wall 20 reduces the volume of a segment of the chambers 22,24 thus forcing the flowable materials M1,M2 past the membrane 14 and through the applicator 18. The user can continue to press on the extending members 264*a*,264*b* to manipulate the outer wall 20 of the container 12 and force the flowable material M from the dispenser 10.

The dispenser of FIG. 54 is similar to the dispenser 10 shown in FIGS. 26-33. Similar structures will be referred to with like reference numerals. The description regarding the dispenser 10 of FIGS. 26-33 generally apply to the dispenser 10 of FIG. 54 and the description regarding FIG. 53 also applies to the dispenser 10 of FIG. 54. The dispenser 10 has an offset membrane 14. Thus the first membrane section 34 is positioned at a different linear location than the second membrane section 36. Accordingly, the first fracturing mechanism 216*a* is positioned proximate the first membrane section 34 and the second fracturing mechanism 216*b* is positioned proximate the second membrane section 36. Thus the first fracturing mechanism 216*a* is offset form the second fracturing mechanism 216*b*. Operation of the dispenser 54 is similar as described above with respect to the dispenser shown in FIG. 53. With the offset feature, the chambers can have different volumes and fracturing the membrane sections 34,36 one at a time is made easier for the user.

As discussed herein the dispensers 10 in FIGS. 53 and 54 can be one piece injection molded dispensers in exemplary embodiments. The dispensers 10 can be made of a variety of injected molded materials. The dispenser can be made from materials that are chemically-resistant to that the dispensers can be used to container more different types of materials. For example, the dispensers can be made from materials including 100% polypropylene, or 100% nylon or 100% polyvinylidene fluoride. With the use of the fracturing mechanism 216*a*,216*b*, more force can be applied to the membrane 14 wherein the weld seams 40 can be made thicker than in previous embodiments. This also helps in being able to use the dispenser to hold additional materials.

Thus, the dispenser 10 of FIGS. 53 and 54 can be used to hold and dispense a surgical prep solution such as chlorohexidine gluconate (CHG). Prior to the dispensers of the present invention, CHG-based solutions typically had to be stored in glass containers because the injected molded materials did not have sufficient chemically resistant properties to store CHG while having a membrane that could be operably fracturable. Thus, in a certain exemplary embodiment, the dispensers of FIGS. 53 and 54 could be used to contain CHG solution in one chamber 22 and, for example, a dye or colorant in the other chamber 24. Operation would be consistent as described above wherein after the membrane sections 34,36 are fractured by the respective fracturing mechanisms 216*a*,216*b*, the CHG solution mixes with the colorant wherein the mixture can be dispensed onto a skin receiving surface at an incision site. It is further understood that the CHG solution could be incorporated with cyano-acrylic to act as a sealant and also be used with a colorant. The CHG solution could also be used with an activator wherein the solution serves to close incisions. The components contained and dispensed from the dispensers of FIGS. 53 and 54 could also include adhesive components that are separately stored such as adhesives used with an initiator/activator/accelerant to mix with the adhesive which is mixed and then dispensed from the dispenser 10. It is understood that when mixtures requiring additional components need to be used, additional materials can be positioned in the mixing chamber and/or the applicator can be impregnated with additional materials to form the mixture.

Various embodiments of the dispenser of the present invention have been disclosed herein and include several different features. It is understood that any of the various features of the several different embodiments can be combined as desired in accordance with the invention.

It is understood that the "first" and "second" designations for the dispenser of the present invention can be reversed as desired. It is further understood that the term "outer" when describing the outer wall of the dispenser is a relative term. It is understood that the dispenser of the present invention could be incorporated into other structures that may encompass the outer wall. The outer wall of the dispenser of the present invention, cooperates with the membrane and dividing wall to define the chambers of the dispenser.

It is further understood that the membranes disclosed having the non-rupturable member are the most preferred embodiments of the invention. It is contemplated that the dispenser can be formed having a membrane without a non-rupturable member. In such configuration, the interface between the dividing wall and the membrane can be rupturable wherein the dividing wall can fracture from the membrane providing an additional pathway for the flowable materials in the first chamber and second chamber to mix. Thus, the dividing wall would be spaced away from the membrane. The membrane in such embodiment may be considered to be single section membrane rather than being defined into separate sections by the non-rupturable member. When the membrane is fractured along at least one weld seam, the mixture of the first and second flowable materials can be dispensed through the openings in the membrane.

The dispenser 10 is designed to primarily contain and dispense flowable materials that are fluids. Other flowable materials can also be used. For example, in one embodiment the flowable materials M1, M2 could both be fluids. In another embodiment, the first flowable material M1 could be a liquid, and the second flowable material M2 could be a powder to be mixed with the fluid. Other combinations depending on the use are also permissible. This permits the dispenser 10 to be used in a wide variety of uses, and contain and dispense a large variety of fluids and other flowable substances. The following is a non-exhaustive discussion regarding the many possible uses for the dispenser of the present invention. It is understood that related uses to those described below are also possible with the dispenser.

As discussed, the dispenser of the present invention can be used in a variety of applications where multiple components are separately stored and are mixed at a desired time to form a mixture to be dispensed from the dispenser. In one particular application, the dispenser can be used in a surgical application where a surgical prep solution is prepared and dispensed onto an incision site of a patient. Because of the unique formulations that can be used to injection mold the dispensers 10, the dispensers 10 are capable of containing a CHG-based solution to be used in surgical preparation settings. In such applications, a dye or colorant is used with the CHG solution wherein the CHG solution is initially separately stored from the colorant. It is understood that the dispenser 10 is filled with the CHG-based solution in one of the first chamber 22 and the second chamber 24. The colorant is filled in the other chamber. The distal end of the dispenser 10 is sealed to close the chambers 22,24. It is further understood that the dispenser 10 with the CHG-based solution is appropriately sterilized. The dispenser 10,210 is used in a surgical setting wherein a patient's skin in prepared for an incision by a surgeon. The membrane 14 of the dispenser 10 is activated by a medical worker as described above wherein the first section 34 of the membrane 14 and the second section 36 of the membrane 14 are fractured. The CHG-based solution and the colorant pass through the membrane 14 and are mixed in the mixing chamber 16 to form a mixture MX. As described above, the mixture MX saturates the application 18, and the applicator 18 is pressed against a patient's skin S all around the incision location. The mixture MX is deposited onto the patient's skin as shown wherein the skin is sanitized in preparation for surgery. It is understood that utilizing the colorant, or dye, allows the medical personnel to decipher where the mixture MX has been deposited. While the colorant can be introduced into the CHG solution in different ways, the dispenser 10 allows the components to be separately stored until mixing and dispensing is desired. Once the mixture MX is deposited, the patient is ready for an incision by the surgeon. In certain other embodiments, the dispensers can contain a CHG-based solution that also incorporates a skin adhesive. One type of such solution is a cyano-acrylic chlorhexidine gluconate solution (CACHG). In such embodiments, this particular CHG-based solution having the skin adhesive is used to prepare the skin as well as assist in closing the incision.

The dispenser of the present invention is designed to primarily contain and dispense flowable materials that are fluids. Other flowable materials can also be dispensed. For example, the flowable material could be a liquid, powder, gel or other type of flowable substance or flowable material. Also, in other embodiments such as dispensers containing multiple chambers for different flowable materials, the flowable materials M1, M2 could both be fluids. In another embodiment, the first flowable material M1 could be a liquid, and the second flowable material M2 could be a powder to be mixed with the fluid. Other combinations depending on the use are also permissible.

This permits the dispenser 10 to be used in a wide variety of uses and applications, and contain and dispense a large variety of fluids and other flowable substances. The following is a non-exhaustive discussion regarding the many possible uses for the dispenser of the present invention, and in particular, the types of materials that are capable of being contained in the dispensers and dispensed therefrom. It is understood that related uses to those described below are also possible with the dispenser. It is also understood that the following discussion of potential uses is applicable to any of the dispenser embodiments disclosed and discussed herein.

In one example, the dispenser of the present invention can be used in medical applications. In one particular exemplary embodiment, the dispenser may contain a surgical antiseptic such as for cleaning and preparing a body area for incision, and sometimes referred to as a surgical prep solution. One type of antiseptic may be chlorohexidine gluconate (CHG). This CHG-based antiseptic could also be combined with a medical sealant such as cyano-acrylic wherein the dispenser is used to contain and dispense cyano-acrylic chlorohexidine gluconate (CACHG). Other types of medical sealants could also be used. Other types of antiseptics could be iodine-based such as iodophoric skin tinctures, which are commercially available. Other antiseptics and antimicrobial agents could also include other iodine-based complexes, alcohol-based complexes or peroxides. Additional additives may also be used with the antiseptic such as colorants. A single chamber dispenser may be used in such an application, but a multi-chamber dispenser such as disclosed herein may also be used.

In another example, the dispenser of the present invention can be used in adhesive-type applications. The dispenser can dispense a flowable material or mixture that is an adhesive, epoxy, or sealant, such as an epoxy adhesive, craft glue, non-medical super glue and medical super glue. The dispenser could also be used with shoe glue, ceramic epoxy and formica repair glue. The dispenser could further be used for a variety of other adhesive dispensing applications, mastic-related resins or the like.

In another example, the dispenser of the present invention can be used in automotive applications. The dispenser can dispense a flowable material or mixture that is an automotive product, such as a rear view mirror repair kit, a vinyl repair kit, auto paints, an auto paint touch up kit, a window replacement kit, a scent or air freshener, a windshield wiper blade cleaner, a lock de-icer, a lock lubricant, a liquid car wax, a rubbing compound, a paint scratch remover, a glass/mirror scratch remover, oils, radiator stop-leak, a penetrating oil, or a tire repair patch adhesive. Additional automotive applications could be for general auto/motorcycle or bicycle repair kits including chain oils.

In another example, the dispenser of the present invention can be used in chemistry-related applications. The dispenser can dispense a flowable material or mixture that is a chemistry material such as a laboratory chemical, a buffer solution, a rehydration solution of bacteria, a biological stain, or a rooting hormone. The dispenser may also be used as a chemical tester. In one such application, the dispenser can be used for testing drinks for various "date rape" drugs. Other types of chemical testers are also possible. The dispenser could be used to contain various types of chemicals including solvents. In a particular application, the additional material formulations used to form the dispenser allow the dispenser to store and dispense methyl ethyl ketone.

In another example, the dispenser of the present invention can be used to dispense a flowable material or mixture is a cosmetic and beauty supply/toiletry product. For example, the dispenser can be used for a nail polish, lip gloss, body cream, body gel, body paints, hand sanitizer, nail polish remover, liquid soaps, skin moisturizers, skin peels, tooth whiteners, hotel samples, mineral oils, toothpastes, mouthwash or sunscreens. The flowable material could also be a fragrance such as women's perfume or men's cologne. The flowable material could also be tattoo inks. The flowable material could be used for solutions for treating and/or removing tattoo ink.

The cosmetic applications could also include hair care type applications. In another particular example, the dispenser of the present invention can be used in a hair dye kit. Certain hair dye kits come in multiple components that are separately stored wherein the dispenser embodiment disclosed herein having a dividing wall that cooperates to define separate chambers can be utilized. Thus, the dispenser of the present invention can be used in a two-part hair care product such as a hair dye kit. A first flowable substance of the hair dye kit can be carried in the first chamber, and a second flowable substance of the hair dye kit can be carried in the second chamber. The membrane is ruptured wherein the two flowable substances can be mixed together to form a mixture or solution. The mixture or solution can then be dispensed from the dispenser onto the hair of a user. The dispenser can also dispense a flowable material or mixture in other hair care products, such as hair bleaches, hair streaking agent, hair highlighter, shampoos, other hair colorants, conditioners, hair gels, mousse, hair removers, or eyebrow dye.

In another example, the dispenser of the present invention can be used in crafting applications or stationary products. The dispenser can also dispense a large variety of stationery or craft products, such as magic markers, glitter gels, glitter markers, glitter glues, gel markers, craft clues, fabric dyes, fabric paints, permanent markers, dry erase markers, dry eraser cleaner, glue sticks, rubber cement, typographic correction fluids, ink dispensers and refills, paint pens, counterfeit bill detection pen, envelope squeeze moisturizers, adhesive label removers, highlighters, and ink jet printer refills.

In another example, the dispenser of the present invention can also dispense a flowable material or mixture that is an electronics-related product. For example, the electronics product could be a cleaning compound, a telephone receiver sanitizer, cell phone cleaner or protectants, a keyboard cleaner, a cassette recorder cleaner, audio/video disc cleaner, a mouse cleaner, or a liquid electrical tape.

In another example, the dispenser of the present invention can dispense a flowable material or mixture in food product applications. For example, the food product may be food additives, food colorings, coffee flavorings, cooling oils, spices, flavor extracts, food additives, drink additives, confections, cake gel, pastry gel, frostings, sprinkles, breath drops, condiments, sauces, liquors, alcohol mixes, energy drinks, or herbal teas and drinks.

In another example, the dispenser of the present invention can be used in home repair product and home improvement applications. The dispenser can also dispense a flowable material that is a home repair product, such as a caulking compounds or materials, a scratch touch up kit, a stain remover, a furniture repair product, a wood glue, a patch lock, screw anchor, wood tone putty or porcelain touch-up. The dispenser could also dispense a plumbing flux applicator, rust remover and tree wound treatment. In certain home repair or home improvement applications, the dispenser can be used in paint applications. The dispenser can dispense a variety of paint products such as general paints including interior/exterior paints, novelty paints, paint additives, wood stain samples, varnishes, stains, lacquers, caulk, paint mask fluid or paint remover.

In another example, the dispenser of the present invention can be used in household related products. For example, the dispenser could be used for cleaning agents, pest control products, a fish tank sealant or a fish tank treatment, a leak sealant, a nut/bolt locker, screw tightener/gap filler, a super glue remover or goo-b-gone. The dispenser could also be used for a colorant dispenser, or disinfectants, a plant food, fertilizers, bug repellants or a cat litter deodorant. The dispenser could also dispense toilet dyes and treatments, eyeglass cleaners, shoe polishes, clothing stain removers, carpet cleaners and spot removers, multi-purpose oils, and ultrasonic cleaner concentrate. The household product could include a variety of pet-related products including but not limited to an animal medicine dispenser, pet medications, animal measured food dispenser, pet shampoos or odor eliminator liquids. A large variety of pest control products can be dispensed by the dispenser, including insect attractants, pesticides, pet insect repellants, pest sterilizers, insect repellants, lady bug attractant and fly trap attractant. The household product could also include various types of polishes, reagents, indicators and other products.

In another example, the dispenser of the present invention can be used in lubricant applications. The dispenser can dispense a large variety of lubricants including industrial lubricants, oils, greases, graphite lubricants or a dielectric grease.

The dispenser of the present invention can also be used in other medical applications including medical related products, medicinal products and medicaments. Additional medical related product applications can include skin adhesive kits to be used in place of traditional stitching products. As discussed, the dispenser could also be used with topical antiseptics, antimicrobials and surgical scrub products. In addition, the dispenser 10 can dispense a large variety of medicinal products, such as blister medicines, cold sore treatments, insect sting and bite relief products, skin cleaning compounds, skin sealing solutions, skin rash lotions, nasal sanitizers, nasal medications, tissue markers, topical antimicrobials, topical demulcent, treatments for acne such as acne medications, umbilical area antiseptics, cough medicines, waterless hand sanitizers, toothache remedies, cold medicines, sublingual dosages or wart treatments. The dispenser could also be used to dispense compositions for treating various skin conditions. The dispenser could also be used in conjunction with a medical device product. Other medical related applications could include various types of dental related products including different types of compounds and treatments applied to a patients' teeth. The dispenser could also be used in veterinary related products.

In another example, the dispenser of the present invention can be used in novelty products. For example, the dispenser can contain materials in a glow-stick device. In such instance, the dispenser is a container that may contain multiple components separately stored until activation to create a glowing state in response to mixture of the components. Furthermore, the dispenser can dispense a flowable material or mixture that is a chemiluminescent light, a Christmas tree scent, a glitter gel, and a face paint. Other types of novelty paints could also be used with the dispenser.

In another example, the dispenser of the present invention can be used in sports products. The dispenser can dispense a variety of sports products including sports eye black, football hand glue, and baseball glove conditioner and pine tar. The dispenser can also dispense wildlife lures. The dispenser can be used in various camping related applications including portable lighting fuels for camp lights or other devices and tent repair kits. The dispenser can also be used in bingo or other game markers.

In another example, the dispenser of the present invention can be used in test kit applications. The dispenser can dispense a flowable material or mixture that is a test kit, such as a lead test kit, a drug kit, a radon test kit, a narcotic test kit, a swimming pool test kit (e.g., chlorine, pH, alkalinity etc.), a home water quality tester, a soil test kit, a gas leak detection fluid, a pregnancy tester, or a respirator test kit. The dispenser can also dispense a flowable material or mixture that as part of a medical device test kit, such as a culture media, a drug monitoring system, a microbiological reagent, a *streptococcus* test kit, or a residual disinfectant tester. The dispenser may also be used in diagnostic testing kits, explosive testing kits or other test kits. The dispenser can be used in breathalyzer tests, culture media samples and drug test kits.

In another example, the dispenser of the present invention can be used in personal care products or wellness-related products. The dispenser can also dispense a flowable material or mixture that is a personal care product, such as shaving cream or gel, aftershave lotion, skin conditioner, skin cream, skin moisturizer, petroleum jelly, insect repellant, personal lubricant, ear drops, eye drops, nose drops, corn medications, nail fungal medication, aging liquids, acne cream, contact lens cleaner, denture repair kit, finger nail repair kit, liquid soaps, sun screen, lip balm, tanning cream, self-tanning solutions, eye wash solution finger nail repair kits. The dispenser can also be used with aroma therapy products and homeopathic preparations. The dispenser can also dispense various vitamins, minerals, supplements and pet vitamins.

The dispenser can also dispense a flowable material or mixture in a variety of other miscellaneous applications. Such miscellaneous applications may include, but not be limited to use in connection with a suction device for culture sampling, taking various liquid samples or taking various swabbing samples. The dispenser could also be used for float and sinker devices, dye markers, microbiological reagents, and also for manufacturing parts assembly liquids and irrigation solutions. The dispenser may also be used as a chalk dispenser such as in construction applications.

Thus, the dispenser can be used in many different applications including mechanical, chemical, electrical or biomedical uses. The dispenser can dispense any variety of flowable materials including liquids and powders, and further including a liquid and a powder, two or more powders, or two or more liquids. The dispenser may be used as part of 2-part system (mix before use) including a liquid with a powder, a liquid with a liquid, a powder with a powder, or sealed inside another tube or product container or partially sealed, connected or attached to another container. The dispenser may also be used as part of a plunger dispensing system.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A dispenser for dispensing flowable materials, the dispenser comprising:

a container having an outer wall, a dividing wall and a membrane operably connected to define a first chamber, a second chamber and a third chamber, the dividing wall connected to the membrane at an interface, the first chamber defining a first volume and configured to contain a first flowable material and the second chamber defining a second volume and configured to contain a second flowable material, the membrane having a first section having a first rupturable member and a second section having a second rupturable member, the first section separated from the second section by the interface, wherein the first section of the membrane is longitudinally offset from the second section of the membrane, the third chamber being positioned adjacent the membrane generally opposite the first chamber and the second chamber, wherein the third chamber defines a third volume and is configured to receive the first flowable material and the second flowable material upon rupture of the first rupturable member and the second rupturable member wherein a mixture is formed, wherein the first volume and the second volume are collectively approximately equal to the third volume.

2. The dispenser of claim 1 wherein the first rupturable member is a first weld seam.

3. The dispenser of claim 2 wherein membrane has a thickness and the first weld seam has a thickness less than the thickness of the membrane.

4. The dispenser of claim 3 wherein the first weld seam comprises a plurality of weld seams.

5. The dispenser of claim 4 wherein the weld seams extend radially from proximate a midpoint of the interface.

6. The dispenser of claim 2 wherein the membrane is formed by injected material wherein a first segment of injected material abuts a second segment of injected material to form the first weld seam.

7. The dispenser of claim 2 wherein a force applied to the membrane causes rupture of the first weld seam wherein the membrane is configured to allow the first flowable material to flow from the first chamber and past the membrane into the third chamber.

8. The dispenser of claim 7 wherein after the first weld seam is ruptured, the membrane returns to a substantially closed position when force is removed from the membrane wherein the membrane is configured such that the first flowable material does not pass from the first chamber and past the membrane.

9. The dispenser of claim 1 wherein the second rupturable member is a second weld seam.

10. The dispenser of claim 9 wherein the membrane has a thickness and the second weld seam has a thickness less than the thickness of the membrane.

11. The dispenser of claim 10 wherein the second weld seam comprises a plurality of weld seams.

12. The dispenser of claim 11 wherein the weld seams extend radially from substantially a midpoint of the interface.

13. The dispenser of claim 9 wherein the membrane is formed by injected material wherein a first segment of injected material abuts a second segment of injected material to form the second weld seam.

14. The dispenser of claim 9 wherein a force applied to the membrane causes rupture of the second weld seam wherein the membrane is configured to allow the second flowable material to flow from the second chamber and past the membrane into the third chamber.

15. The dispenser of claim 14 wherein after the second weld seam is ruptured, the membrane returns to a substantially closed position when force is removed from the membrane wherein the membrane is configured such that the second flowable material does not pass from the second chamber and past the membrane.

16. The dispenser of claim 1 wherein the first rupturable member extends radially from substantially a midpoint of the interface.

17. The dispenser of claim 1 wherein the first rupturable member comprises a plurality of weld seams that converge to a point proximate the interface.

18. The dispenser of claim 1 wherein the first rupturable member comprises a plurality of weld seams that converge to a point spaced from the interface.

19. The dispenser of claim 1 wherein the interface forms a non-rupturable member that extends across the membrane.

20. The dispenser of claim 1 wherein the interface is positioned such that the first section of the membrane is generally equal in size to the second section of the membrane.

21. The dispenser of claim 1 wherein the dividing wall is disposed within the container such that it divides the container into the first chamber and second chamber wherein the first chamber is generally equally sized to the second chamber.

22. The dispenser of claim 1 wherein the dividing wall is disposed within the container such that the dividing wall divides the container wherein the first chamber and the second chamber are unequally sized.

23. The dispenser of claim 1 wherein the dividing wall has a proximal end connected to the membrane at the interface.

24. The dispenser of claim 1 wherein the dividing wall is integral with the membrane at the interface.

25. The dispenser of claim 1 wherein the interface defines a non-rupturable member.

26. The dispenser of claim 1 wherein a force applied to the membrane causes rupture of the first rupturable member and the second rupturable member.

27. The dispenser of claim 1 wherein the first rupturable member is a first weld seam and the second rupturable member is a second weld seam wherein force applied to the membrane causes rupture of the first weld seam and the second weld seam wherein the membrane is configured such that the first flowable material flows past the first section of the membrane and the second flowable material flows past the second section of the membrane.

28. The dispenser of claim 27 wherein the first weld seam and the second weld seam are formed such that when force is applied to the membrane, the first weld seam ruptures prior to rupture of the second weld seam.

29. The dispenser of claim 1 wherein when force is applied to the membrane, a rupture of the first rupturable member occurs prior to a rupture of the second rupturable member.

30. The dispenser of claim 1 wherein the third chamber defines an opening, wherein the opening receives an applicator.

31. The dispenser of claim 30 wherein the mixture is dispensed from the third chamber and through the applicator.

32. The dispenser of claim 1 wherein the interface defines a generally planar member and positioned generally transverse to the first section of the membrane and the second section of the membrane.

33. The dispenser of claim 1 wherein the container has a unsealed distal end configuration wherein the dividing wall has a plurality of undulations, and wherein the container has a sealed distal end configuration wherein the undulations have a generally flattened configuration.

34. The dispenser of claim 33 wherein the undulations are v-shaped notches.

35. The dispenser of claim 33 wherein the undulations are u-shaped notches.

36. The dispenser of claim 33 wherein the undulations are zigzag shaped.

37. A dispenser for dispensing flowable materials, the dispenser comprising:

a container having an outer wall, a dividing wall and a membrane operably connected to define a first chamber and a second chamber, the dividing wall connected to the membrane at an interface, the first chamber configured to contain a first flowable material and the second chamber configured to contain a second flowable material, the membrane having a first section having a first rupturable member and a second section having a second rupturable member, the first section separated from the second section by the interface, wherein the first section of the membrane is longitudinally offset from the second section of the membrane.

38. A dispenser for dispensing flowable materials, the dispenser comprising:

a container having an outer wall, a dividing wall and a membrane operably connected to define a first chamber and a second chamber, the dividing wall connected to the membrane at an interface, the first chamber configured to contain a first flowable material and the second chamber configured to contain a second flowable material, the membrane having a first section having a first rupturable member and a second section having a second rupturable member, the first section separated from the second section by the interface, wherein the first section of the membrane is longitudinally offset from the second section of the membrane, wherein the container has an unsealed distal end configuration wherein the dividing wall has an undulation, and wherein the container has a sealed distal end configuration wherein the undulation has a generally flattened configuration.

39. A dispenser for dispensing flowable materials, the dispenser comprising:

a container having an outer wall, a dividing wall and a membrane operably connected to define a first chamber and a second chamber, the dividing wall connected to the membrane at an interface, the first chamber configured to contain a first flowable material and the second chamber configured to contain a second flowable material, the membrane having a first section having a first weld seam and a second section having a second weld seam, the first section separated from the second section by the interface, wherein the first section of the membrane is longitudinally offset from the second section of the membrane.

* * * * *